US011371132B2

(12) United States Patent
Umehara et al.

(10) Patent No.: US 11,371,132 B2
(45) Date of Patent: Jun. 28, 2022

(54) NITRIDED PART

(71) Applicant: NIPPON STEEL CORPORATION, Tokyo (JP)

(72) Inventors: Takahide Umehara, Tokyo (JP); Masato Yuya, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 31 days.

(21) Appl. No.: 16/764,756

(22) PCT Filed: Nov. 16, 2018

(86) PCT No.: PCT/JP2018/042548

§ 371 (c)(1),
(2) Date: May 15, 2020

(87) PCT Pub. No.: WO2019/098340

PCT Pub. Date: May 23, 2019

(65) Prior Publication Data

US 2020/0362447 A1 Nov. 19, 2020

(30) Foreign Application Priority Data

Nov. 16, 2017 (JP) ..... JP2017-220885
Nov. 16, 2017 (JP) ..... JP2017-220894

(51) Int. Cl.

| | |
|---|---|
| ***C22C 38/00*** | (2006.01) |
| ***C22C 38/02*** | (2006.01) |
| ***C22C 38/38*** | (2006.01) |
| ***C22C 38/18*** | (2006.01) |
| ***C23C 8/26*** | (2006.01) |

(Continued)

(52) U.S. Cl.

CPC ..... *C23C 8/26* (2013.01); *C22C 38/001* (2013.01); *C22C 38/002* (2013.01); *C22C 38/008* (2013.01); *C22C 38/02* (2013.01); *C22C 38/06* (2013.01); *C22C 38/18* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search

CPC ..... C22C 38/001; C22C 38/02; C22C 38/18; C22C 38/38
USPC ..... 148/332
See application file for complete search history.

(56) References Cited

U.S. PATENT DOCUMENTS

2015/0053311 A1 2/2015 Shimizu et al.
2016/0130692 A1 5/2016 Birky et al.
(Continued)

FOREIGN PATENT DOCUMENTS

JP 2013-221203 A 10/2013
JP 2015-117412 A 6/2015
(Continued)

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

The present invention has as its technical problem the provision of a part excellent in contact fatigue strength or wear resistance in addition to the rotating bending fatigue strength. In the present invention, the contents of the constituents of the steel, in particular C, Mn, Cr, V, and Mo, are adjusted in accordance with the targeted properties and nitrided parts are prepared while controlling the nitriding potential.

4 Claims, 9 Drawing Sheets

(51) Int. Cl.

| | |
|---|---|
| ***C22C 38/06*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(56) References Cited

U.S. PATENT DOCUMENTS

| | | | |
|---|---|---|---|
| 2018/0245195 | A1 | 8/2018 | Umehara et al. |
| 2020/0040439 | A1 | 2/2020 | Umehara et al. |

FOREIGN PATENT DOCUMENTS

| | | | |
|---|---|---|---|
| JP | 2016-211069 | A | 12/2016 |
| JP | 2017-160517 | A | 9/2017 |
| WO | WO 2017/043594 | A1 | 3/2017 |
| WO | WO 2018/066666 | A1 | 4/2018 |

NITRIDED PART

FIELD

The present invention relates to a steel part treated by gas nitriding.

BACKGROUND

The steel parts used in automobiles and various types of industrial machinery etc. are improved in fatigue strength, wear resistance, and seizing resistance and other mechanical properties by carburizing and quenching, induction hardening, nitriding, and nitrocarburizing and other surface hardening heat treatment.

Nitriding and nitrocarburizing are performed in a ferrite region of the $A_1$ point or less and phase transformation does not occur during treatment, so the heat treatment strain can be reduced. Therefore, nitriding and nitrocarburizing are mostly used for parts requiring high dimensional precision or large sized parts. For example, they are applied to gears used for transmission parts of automobiles and crankshafts used for engines.

Nitriding is method of treatment of causing nitrogen to penetrate into the surface of the steel material. For the medium used for the nitriding, there are a gas, salt bath, plasma, etc. For the transmission parts of automobiles, gas nitriding, which is excellent in productivity, is mainly being applied. Due to the gas nitriding, the surface of the steel material is formed with a compound layer of a thickness of 10 μm or more (layer at which $Fe_3N$ or other nitride has precipitated). Further, the surface layer of the steel material below the compound layer is formed with a hardened layer of the nitrogen diffusion layer. The compound layer is mainly comprised of $Fe_{2-3}N(\varepsilon)$ and $Fe_4N(\gamma')$. The hardness of the compound layer is extremely high compared with a steel core of a nonnitrided layer. For this reason, the compound layer improves the wear resistance and contact fatigue strength of a steel part at the initial time of use.

PTL 1 discloses a nitrided part improved in bending fatigue strength by making a ratio of γ' phases in the compound layer 30 mol % or more.

PTL 2 discloses a steel member excellent in wear resistance by making a ratio of γ' phases in the compound layer 0.5 or more, making a thickness of the compound layer of 13 to 30 μm, and making a compound layer thickness/hardened layer depth ≥0.04.

PTL 3 discloses a nitrided part excellent in rotating bending fatigue strength in addition to contact fatigue strength by making a thickness of a compound layer 3 to 15 μm, a phase structure from the surface to a depth of 5 μm an area ratio of 50% or more of γ' phases, a pore area ratio from the surface to a depth of 3 μm less than 10%, and a compressive residual stress of the compound layer surface 500 MPa or more.

CITATIONS LIST

Patent Literature

[PTL 1] Japanese Unexamined Patent Publication No. 2015-117412

[PTL 2] Japanese Unexamined Patent Publication No. 2016-211069

[PTL 3] International Publication No. 2018/66666

SUMMARY

Technical Problem

The nitrided part of PTL 1 is gas nitrocarburized using $CO_2$ for the ambient gas, so the surface side of the compound layer easily becomes ε phases and the bending fatigue strength may still become insufficient.

The nitrided part of PTL 2 is not optimized in ranges of constituents of C, Cr, Mo, and V having an effect on the hardness and structure of the compound layer and depending on the nitriding conditions may not become the structure of the compound layer aimed at.

The nitrided part of PTL 3 focuses on control of the γ' phase ratio of the surface layer part of the compound layer and is still insufficient in findings regarding the phase ratio and various types of fatigue strength in the entire region of the compound layer in the depth direction, so it is believed that there is room for improvement.

An object of the present invention is to provide a part excellent in contact fatigue strength or wear resistance in addition to rotating bending fatigue strength.

Solution to Problem

The inventors focused on the form of the compound layer formed on the surface of the steel material by nitriding and investigated the relationship with the fatigue strength.

As a result, they discovered that by nitriding steel adjusted in constituents under control of the nitriding potential, it is possible to make the structure of the compound layer formed at the surface layer of the steel after nitriding mainly the γ' phases, suppress the formation of a pore layer at the surface layer (below, referred to as the "porous layer"), and make the hardness of the compound layer a certain value or more to thereby fabricate a nitrided part having excellent rotating bending fatigue strength and contact fatigue strength or wear resistance.

The present invention was made after further study based on the above findings and has as its gist the following:

(1) A nitrided part comprising a steel core containing, by mass %, C: 0.05 to 0.35%, Si: 0.05 to 1.50%, Mn: 0.20 to 2.50%, P: 0.025% or less, S: 0.050% or less, Cr: 0.50 to 2.50%, V: 0.05 to 1.30%, Al: 0.050% or less, N: 0.0250% or less, Mo: 0 to 1.50%, Cu: 0 to 0.50%, Ni: 0 to 0.50%, Nb: 0 to 0.100%, Ti: 0 to 0.050%, B: 0 to 0.0100%, Ca: 0 to 0.0100%, Pb: 0 to 0.50%, Bi: 0 to 0.50%, In: 0 to 0.20%, Sn: 0 to 0.100%, and a balance of Fe and impurities, a nitrogen diffusion layer formed on the steel core, and a compound layer formed on the nitrogen diffusion layer, containing mainly nitrided iron, and having a thickness of 5 to 15 μm, in a cross-section vertical from a surface of the compound layer, a pore area ratio in a range of a depth of 3 μm from the surface is 10% or less, if defining the X determined based on the contents of C, Mn, Cr, V, and Mo at the steel core as $$X=-2.1\times C+0.04\times Mn+0.5\times Cr+1.8\times V-1.5\times Mo, \quad \text{(i)}$$

$0\leq X\leq 0.25$ and an area ratio of γ' phases of the nitrided iron in the compound layer is 50% or more and 80% or less or (ii) $0.25\leq X\leq 0.50$ and an area ratio of γ' phases of the nitrided iron in the compound layer is 80% or more.

(2) The nitrided part according to (1) wherein $0\leq X\leq 0.25$ and an area ratio of the γ' phases of the nitrided iron in the compound layer is 50% or more and 80% or less.

(3) The nitrided part according to (1) wherein $0.25\leq X\leq 0.50$ and an area ratio of the γ' phases of the nitrided iron in the compound layer is 80% or more.

Advantageous Effects of Invention

According to the present invention, it is possible to obtain a nitrided part excellent in contact fatigue strength or wear resistance in addition to rotating bending fatigue strength. A nitrided part excellent in contact fatigue strength in addition to rotating bending fatigue strength is optimal for gear parts, while a nitrided part excellent in wear resistance in addition to rotating bending fatigue strength is optimal for a CVT and camshaft part.

DESCRIPTION OF EMBODIMENTS

Figure 1:
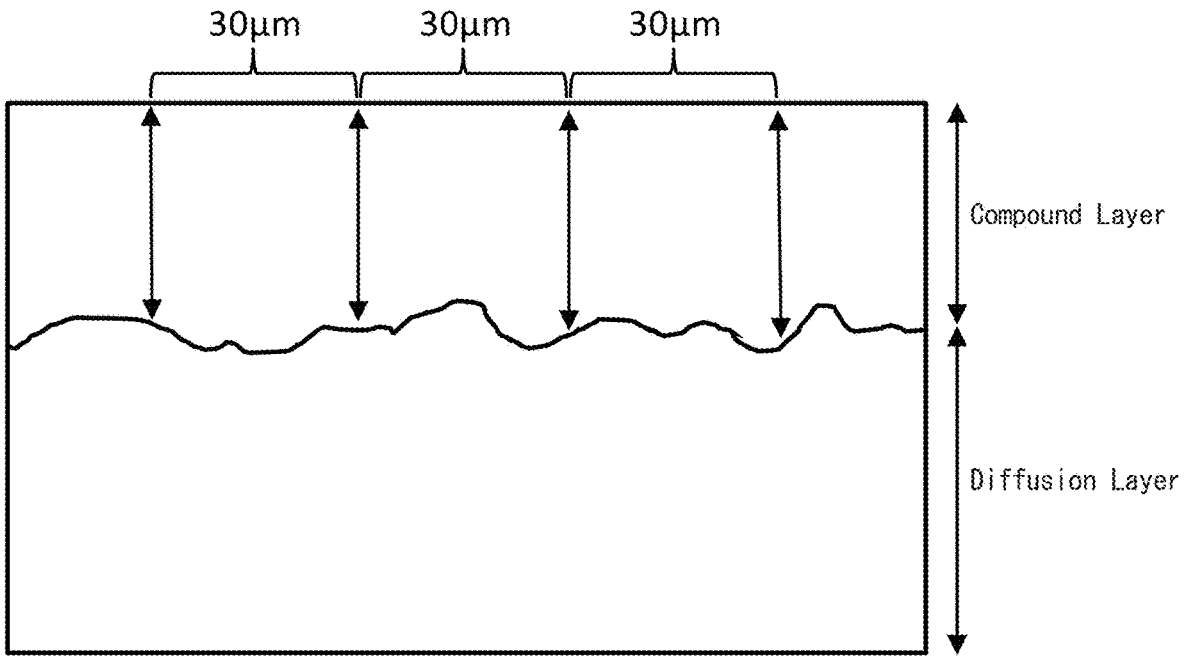
FIG. 1 is a view for explaining a method of measurement of a depth of a compound layer.

In the present invention, by nitriding steel adjusted in constituents to match with the targeted properties while controlling the nitriding potential, it is possible to obtain a nitrided part excellent in contact fatigue strength in addition to rotating bending fatigue strength and a nitrided part excellent in wear resistance in addition to rotating bending fatigue strength respectively in accordance with the constituents of the steel. Below, embodiments of the present invention will be explained in detail.

(1) Nitrided Part According to Present Invention

First, the chemical composition of the steel material used as the material will be explained. Below, the "%" showing the contents of the constituent elements and the concentrations of elements at the surfaces of the parts mean "mass %". Further, the steel core of the nitrided part according to the present invention is provided with the same chemical composition as the steel material used as a material.

C: 0.05 to 0.35%

C is an element necessary for securing the core hardness of the part. For this reason, C has to be 0.05% or more. On the other hand, if the content of C is more than 0.35%, the strength after hot forging becomes too high, so the machineability greatly falls. The preferable lower limit of the C content is 0.08%. Further, the preferable upper limit of the C content is 0.30%.

Si: 0.05 to 1.50%

Si is an element raising the core hardness by solution strengthening. Further, it raises the tempering softening resistance and raises the contact fatigue strength and wear resistance of the part surface which becomes a high temperature under wear conditions. To obtain these effects, Si has to be 0.05% or more. On the other hand, if the content of Si is more than 1.50%, the strength of the steel bars and wire rods and after hot forging becomes too high, so the machineability greatly falls. The preferable lower limit of the Si content is 0.08%. The preferable upper limit of the Si content is 1.30%.

Mn: 0.20 to 2.50%

Mn is an element which forms fine nitrides ($Mn_3N_2$) in the compound layer or diffusion layer and raises the hardness by nitriding and is effective for improvement of the contact fatigue strength or wear resistance and rotating bending fatigue strength. Further, it raises the core hardness by solution strengthening. To obtain these effects, Mn has to be 0.20% or more. On the other hand, if the content of Mn is more than 2.50%, not only does the effect become saturated, but also the hardness of the steel bars and wire rods used as materials and after hot forging becomes too high, so the machineability greatly falls. The preferable lower limit of the Mn content is 0.40%. The preferable upper limit of the Mn content is 2.30%.

P: 0.025% or Less

P is an impurity and segregates at the grain boundaries to cause a part to become brittle, so the content is preferably smaller. If the content of P is more than 0.025%, sometimes the contact fatigue strength or wear resistance and rotating bending fatigue strength fall. The preferable upper limit of the P content for preventing the drop of the rotating bending fatigue strength is 0.018%. The content of P may be 0, but making it completely 0 is difficult. 0.001% or more may also be contained.

S: 0.050% or Less

S is not an essential element, but is usually contained as an impurity even if not intentionally added. The S in the steel is an element which bonds with Mn to form MnS and improve the machineability. To obtain the effect of improvement of the machineability, S is preferably contained in 0.003% or more. However, if the content of S is more than 0.050%, coarse MnS is easily formed and the contact fatigue strength or wear resistance and rotating bending fatigue strength greatly fall. The preferable lower limit of the S content is 0.005%. The preferable upper limit of the S content is 0.030%.

Cr: 0.50 to 2.50%

Cr forms fine nitrides (CrN) in the compound layer or diffusion layer due to nitriding and raises the hardness, so is an element effective for improvement of the contact fatigue strength or wear resistance and rotating bending fatigue strength. To obtain these effects, Cr has to be 0.50% or more. On the other hand, if the content of Cr is more than 2.50%, not only does the effect become saturated, but also the hardness of the steel bars and wire rods used as materials and after hot forging becomes too high, so the machineability remarkably falls. The preferable lower limit of the Cr content is 0.70%. The preferable upper limit of the Cr content is 2.00%.

V: 0.05 to 1.30%

V is an element forming fine nitrides (VN) in the compound layer or diffusion layer to raise the hardness by nitriding, so is effective for improvement of the contact fatigue strength or wear resistance and rotating bending fatigue strength. To obtain these effects, V has to be 0.05% or more. On the other hand, if the content of V is more than 1.30%, not only does the effect become saturated, but also the hardness of the steel bars and wire rods used as materials and after hot forging becomes too high, so the machineability remarkably falls. The preferable lower limit of the V content is 0.10%. The preferable upper limit of the V content is 1.10%.

Al: 0.050% or Less

Al is not an essential element, but is a deoxidizing element. In steel after deoxidation as well, it is included to a certain extent in many cases. Further, it bonds with N to form AlN and has the effect of refining the structure of the steel material before nitriding by the pinning action of austenite grains and of reducing variation in mechanical properties of the nitrided part. To obtain the effect of refining the structure of a steel material, it is preferably included in 0.010% or more. On the other hand, Al easily forms hard oxide-based inclusions. If the content of Al is over 0.050%, the rotating bending fatigue strength remarkably drops. Even if other requirements are satisfied, the desired rotating bending fatigue strength can no longer be obtained. The preferable lower limit of the Al content is 0.020% The preferable upper limit of the Al content is 0.040%.

N: 0.0250% or Less

N is not an essential element, but is usually contained as an impurity even if not intentionally added. The N in steel bonds with Mn, Cr, Al, and V to form $Mn_3N_2$, CrN, AlN, and VN. Among these, Al and V with high nitride-forming tendencies have the effect of refining the structure of the steel material before nitriding and reducing the variation in mechanical properties of the nitrided part by the pinning action of the austenite grains. To obtain the effect of refining the structure of the steel material, inclusion of 0.0030% or more is preferable. On the other hand, if the content of N is more than 0.0250%, coarse AlN is easily formed, so the above effect becomes harder to obtain. The preferable lower limit of the N content is 0.0050%. The preferable upper limit of the N content is 0.0200%.

The chemical constituents of the steel used as a material of the nitrided part according to the present invention include the above elements and has a balance of Fe and impurities. The "impurities" are constituents contained in the raw materials or entering in the process of manufacture and constituents not intentionally included in the steel. The impurities, for example, are 0.05% or less of Te and 0.01% or less of W, Co, As, Mg, Zr, and REM. Te does not have a large effect even if added in 0.30% or less for the purpose of improving the machineability.

Provided, however, that the steel used as a material in the nitrided part of the present invention may also contain the following elements instead of part of the Fe.

Mo: 0 to 1.50%

Mo is an element forming fine nitrides ($Mo_2N$) in the compound layer or diffusion layer formed by nitriding and raises the hardness, so is effective for improvement of the contact fatigue strength or wear resistance and rotating bending fatigue strength. To obtain these effects, Mo is preferably made 0.01% or more. On the other hand, if the content of Mo is over 1.50%, not only does the effect become saturated, but also the hardness of the steel bars and wire rods used as materials and after hot forging becomes too high, so the machineability remarkably falls. The more preferable lower limit of the Mo content is 0.10%. The preferable upper limit of the Mo content is 1.10%.

Cu: 0 to 0.50%

Cu improves the core hardness of the part and the hardness of the nitrogen diffusion layer as a solution strengthening element. To obtain the action of solution strengthening of Cu, 0.01% or more is preferably contained. On the other hand, if the content of Cu is over 0.50%, the hardness of the steel bars and wire rods used as materials and after hot forging becomes too high, so the machineability remarkably falls. In addition, the hot rollability falls. Therefore, this becomes a cause of formation of surface flaws at the time of hot rolling and at the time of hot forging. The preferable lower limit of the Cu content for maintaining the hot rollability is 0.05%. The preferable upper limit of the Cu content is 0.40%.

Ni: 0 to 0.50%

Ni improves the core hardness and surface hardness by solution strengthening. To obtain the action of solution strengthening by Ni, inclusion of 0.01% or more is preferable. On the other hand, if the content of Ni is more than 0.50%, the hardness of the steel bars and wire rods and after hot forging becomes too high, so the machineability remarkably falls. In addition, the alloy cost increases. The preferable lower limit of the Ni content for obtaining sufficient machineability is 0.05%. The preferable upper limit of the Ni content is 0.40%.

Nb: 0 to 0.100%

Nb bonds with C or N to form NbC or NbN and has the effect of refining the structure of the steel material before nitriding and reducing the variation in mechanical properties of the nitrided part due to the pinning action of the austenite grains. To obtain this action, Nb is preferably made 0.010% or more. On the other hand, if the content of Nb is more than 0.100%, coarse NbC or NbN is formed, so the above effect becomes harder to obtain. The preferable lower limit of the Nb content is 0.015%. The preferable upper limit of the Nb content is 0.090%.

Ti: 0 to 0.050%

Ti bonds with N to form TiN and improve the core hardness and surface hardness. To obtain this action, Ti is preferably 0.005% or more. On the other hand, if the content of Ti is more than 0.050%, the effect of improving the core hardness and surface hardness becomes saturated and, in addition, the alloy cost increases. The preferable lower limit of the Ti content is 0.007%. The preferable upper limit of the Ti content is 0.040%.

B: 0 to 0.0100%

The solid solution B has the effect of suppressing the grain boundary segregation of P and improving the toughness. Further, the BN which precipitates by B bonding with N improves the machineability. To obtain these actions, B is preferably made 0.0005% (5 ppm) or more. On the other hand, if the content of B is more than 0.0100%, not only does the above effect become saturated, but also a large amount of BN segregates and therefore the steel material sometimes cracks. The preferable lower limit of the B content is 0.0008%. The preferable upper limit of the B content is 0.0080%.

Ca: 0 to 0.0100%, Pb: 0 to 0.50%, Bi: 0 to 0.50%, In: 0 to 0.20%, and Sn: 0 to 0.100%

In addition, it is possible to include free cutting elements for improving the machineability in accordance with need. As the free cutting elements, Ca, Pb, Bi, In, and Sn may be mentioned. For improving the machineability, one or more types of elements of Ca, Pb, Bi, In, and Sn are preferably included in respective amounts of 0.005% or more. The effect of the free cutting elements becomes saturated even if adding them in large amounts. Further, the hot rollability falls, so the content of Ca is made 0.0100% or less, the content of Pb is made 0.50% or less, the content of Bi is made 0.50% or less, the content of In is made 0.20% or less, and the content of Sn is made 0.100% or less.

The constituents of the nitrided part of the present invention further have to include contents of C, Mn, Cr, V, and Mo (mass %) satisfying $0 \leq -2.1 \times C + 0.04 \times Mn + 0.5 \times Cr + 1.8 \times V -$ 1.5×Mo≤0.50. Elements not included are calculated as 0. Here, the value of X is defined by the following formula. In the following explanation, X will be used for the explanation.

$$X=-2.1\times C+0.04\times Mn+0.5\times Cr+1.8\times V-1.5\times Mo$$

C, Mn, Cr, V, and Mo are elements having effects on the phase structure and thickness of the compound layer. C and Mo have the effects of stabilizing the ε phases and raising the thickness. On the other hand, Mn, Cr, and V have the effects of making the compound layer thinner. For this reason, by designing these elements in certain ranges, the ratio of the γ' phases in the compound layer and the compound layer thickness can be stably controlled and the contact fatigue strength, wear resistance, and rotating bending fatigue strength can be improved.

To obtain these effects, X has to be 0 or more. If less than 0, a ratio of γ' phases effective for the rotating bending fatigue strength is not obtained. On the other hand, if X is more than 0.50, the compound layer becomes thinner and the desired properties cannot be obtained. The area ratio of the γ' phases will be explained later.

Next, the nitrided part of the present invention will be explained.

The nitrided part according to the present invention is manufactured by working a steel material into a rough shape, then nitriding it under predetermined conditions. The nitrided part according to the present invention is provided with a steel core, a nitrogen diffusion layer formed on the steel core, and a compound layer formed on the nitrogen diffusion layer. That is, the nitrided part according to the present invention has a structure with a compound layer on the surface, with a nitrogen diffusion layer at the inside of the compound layer, and with a steel core at the inside of the nitrogen diffusion layer.

The steel core is a part which the nitrogen penetrating from the surface in the nitriding treatment does not reach. The steel core has a chemical composition the same as the steel material used as the material for the nitrided part.

The nitrogen diffusion layer is a part at which the nitrogen penetrating from the surface in the nitriding treatment forms a solid solution in the base phase or precipitates as nitrided iron and nitrided alloy. The nitrogen diffusion layer is strengthened by the solution strengthening of the nitrogen and the particle dispersion strengthening of nitrided iron and nitrided alloy, so the hardness is higher than that of the steel core.

The compound layer is a layer mainly including nitrided iron formed by nitrogen atoms, which penetrate the steel in the nitriding, bonding with iron atoms included in the material. The compound layer is mainly comprised of nitrided iron, but in addition to the iron and nitrogen, oxygen entering from the outside air and one or more types of elements contained in the steel material of the material (that is, elements contained in the steel core) are also included in the compound layer. In general, 90% or more (mass %) of the elements included in the compound layer are nitrogen and iron. The nitrided iron contained in the compound layer is $Fe_{2-3}N$ (c phases) or $Fe_4N$ (γ' phases).

Thickness of Compound Layer: 5 to 15 μm

The thickness of the compound layer has an effect on the contact fatigue strength or wear resistance and rotating bending fatigue strength of the nitrided part. The compound layer has the properties of being harder than the inside nitrogen diffusion layer and steel core, but easily fracturing. If the compound layer is excessively thick, it easily cracks due to pitting or bending. These easily form starting points for fracture and leads to deterioration of the contact fatigue strength and rotating bending fatigue strength. On the other hand, if the compound layer is too thin, the contribution of the hard compound layer becomes smaller, so again the contact fatigue strength and rotating bending fatigue strength fall. In the nitrided part according to the present invention, from the above viewpoint, the thickness of the compound layer is made 5 to 15 μm.

Figure 2:
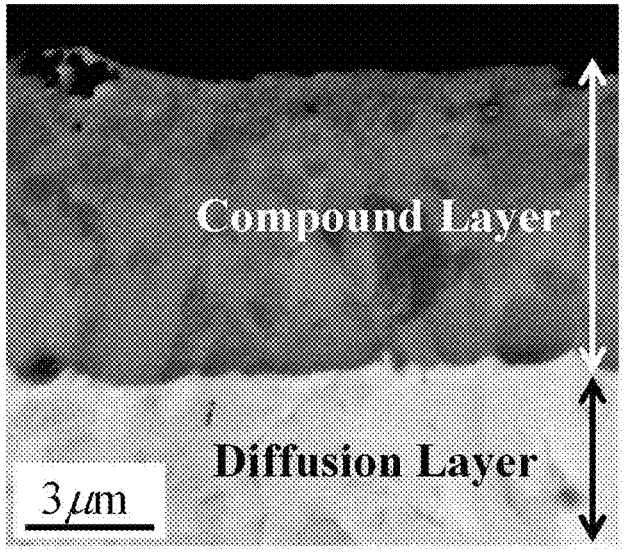
FIG. 2 shows one example of a structural photograph of a compound layer and a diffusion layer.

The thickness of the compound layer is measured by polishing a vertical cross-section of a test material after gas nitriding, etching it, then examining it under a scanning electron microscope (SEM). The etching is performed by a 3% Nital solution for 20 to 30 seconds. The compound layer is present at the surface layer of the low alloy steel and is observed as an uncorroded layer. The compound layer is observed in 10 fields of a structural photograph taken by 4000× (field area: $6.6\times10^2$ $\mu m^2$) and the thickness of the compound layer is measured at 3 points every 10 μm in the horizontal direction of each. Further, the average value of the measured 30 points is defined as the compound layer thickness (μm). FIG. 1 shows an outline of the method of measurement, while FIG. 2 shows one example of a structural photograph of a compound layer and nitrogen diffusion layer. As shown in FIG. 2, the compound layer not corroded by etching and the corroded nitrogen diffusion layer clearly differ in contrast and can be differentiated.

Between the nitrogen diffusion layer which nitrogen penetrates by the nitriding and the steel core which it does not penetrate, a clear difference in contrast such as an interface in the compound layer-nitrogen diffusion layer does not occur. Identification of the boundary between the nitrogen diffusion layer and steel core is difficult. When measuring the hardness profile in the depth direction, the region in which the hardness continuously decreases along with the depth is the nitrogen diffusion layer while the region in which the hardness becomes constant regardless of the depth is the steel core. In the nitrided part, if the difference between the value of the Vickers hardness at a certain point A and the value of the Vickers hardness at a point B further deeper from the point A from the surface by 50 μm is within 1%, it may be judged that both the point A and the point B are in the steel core. Alternatively, under usual nitriding conditions, the nitrogen does not penetrate by 5.0 mm or more from the surface, so the point 5.0 mm deeper from the surface may also be deemed the steel core.

Area Ratio of γ' Phase of Compound Layer: 50% or More

Figure 3:
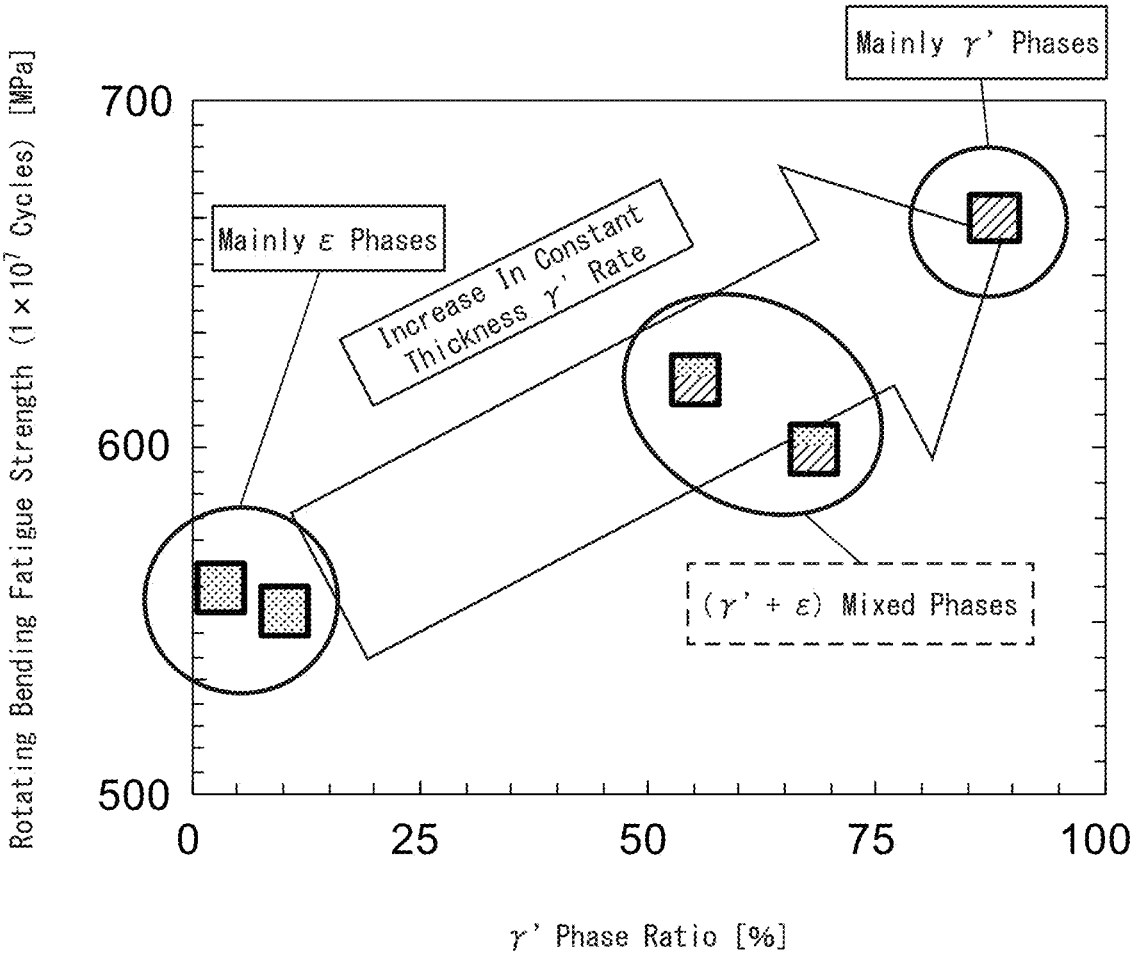
FIG. 3 is a view showing a relationship between a γ' phase ratio and a rotating bending fatigue strength.

The γ' phase is an fcc structure. Compared with an hcp structure of the ε phases, it is stronger in toughness. On the other hand, ε phases are broader in ranges of solid solution of N and C and higher in hardness compared with the γ' phases. Therefore, the inventors engaged in surveys and research focusing on clarifying the structure of a compound layer effective for the contact fatigue strength and rotating bending fatigue strength. As a result, as shown in FIG. 3, it was found that the higher the ratio of the γ' phases in the compound layer, the higher the rotating bending fatigue strength. In particular, it was found that the ratio of the γ' phases effective for the rotating bending fatigue strength is an area ratio of 50% or more at a cross-section vertical to the surface.

Figure 4:
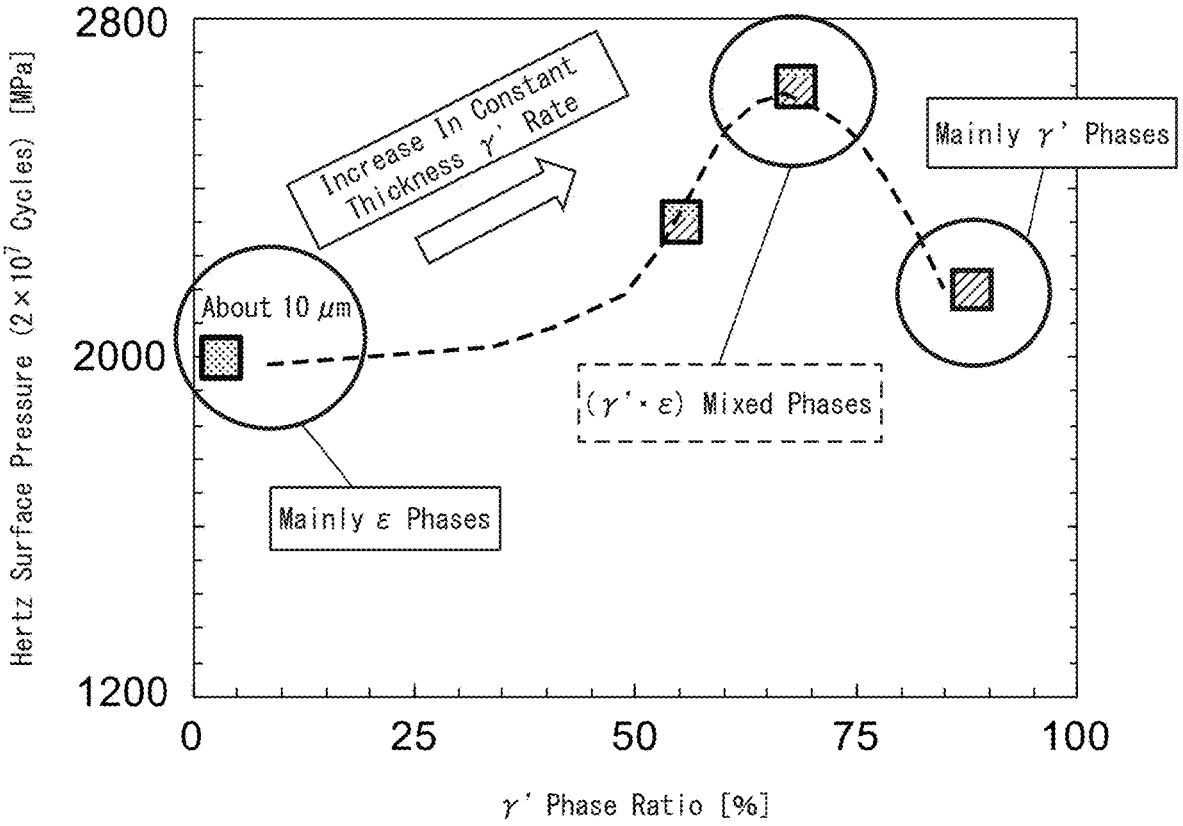
FIG. 4 is view showing a relationship between a γ' phase ratio and a contact fatigue strength.

On the other hand, as shown in FIG. 4, it was found that the contact fatigue strength forms a peak near a ratio of the γ' phases in 70% in the area ratio and the contact fatigue strength falls with γ' phases greater than or less than that. That is, in particular, at a part where contact fatigue strength is stressed (gear part etc.), the area ratio of the γ' phases of the compound layer is preferably made 80% or less. On the other hand, at the part where the rotating bending fatigue strength is emphasized more than the contact fatigue strength (CVT, camshaft part, etc. in automobiles), the higher the area ratio of the γ' phases of the compound layer, the more desirable. In particular, making it 80% or more is desirable.

The area ratio of the γ' phases is found by image processing structural photographs. Specifically, using electron back scatter diffraction (EBSD), 10 structural photographs of cross-sections vertical to the surface at the nitrided part surface layer photographed at 4000× were examined to differentiate the γ' phases and ε phases in the compound layer and the area ratios of the γ' phases in the compound layer are found by binarization by image processing. Further, the average value of the area ratios of the γ' phases of the 10 fields measured is defined as the area ratio (%) of the γ' phases.

Pore Area Ratio of Compound Layer in Range from Surface to Depth of 3 μm: 10% or Less Stress concentrates at the pores present in the compound layer in the range from the surface to a depth of 3 μm. These easily becomes starting points of pitting and bending fatigue fracture. For this reason, the pore area ratio has to be made 10% or less.

Figure 5:
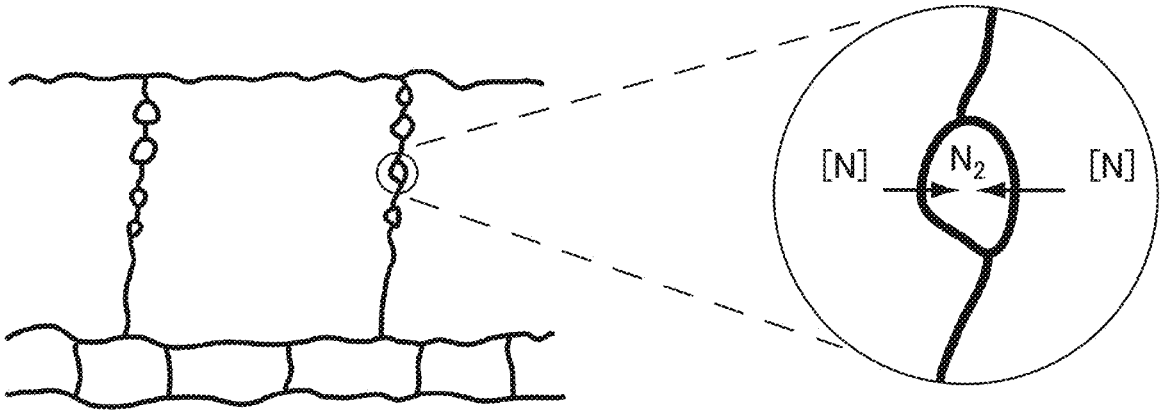
FIG. 5 is a view showing the state of formation of pores in the compound layer.
Figure 6:
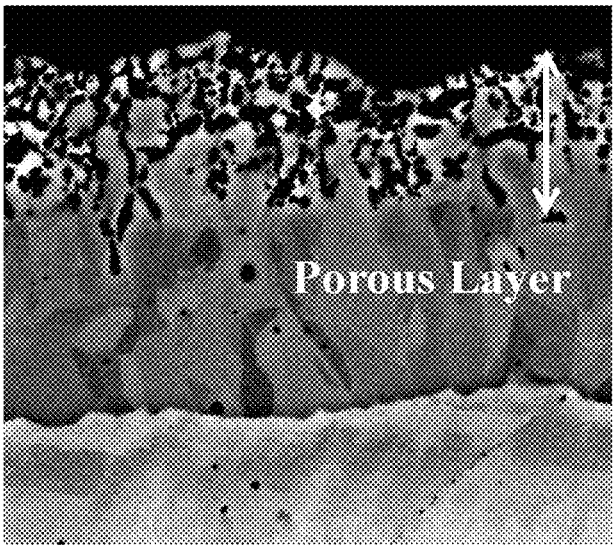
FIG. 6 shows one example of a structural photograph of formation of pores in a compound layer.

Pores are formed at the surface of the steel material with a small constraining force by the base material from the grain boundary and other stable locations energy wise due to desorption of $N_2$ gas from the surface of the steel material along the grain boundaries. $N_2$ is more easily generated the higher the nitriding potential $K_N$ explained later. This is because as the $K_N$ becomes higher, bcc→γ'→ε phase transformation occurs. The amount of solid solution of $N_2$ is larger in the case of the ε phases than the γ' phases, so $N_2$ gas is more easily generated with the ε phases. FIG. 5 shows an outline of formation of pores at a compound layer (Dieter Liedtke et al.: "Nitriding and nitrocarburizing on iron materials", Agne Gijutsu Center, Tokyo, (2011), P. 21) while FIG. 6 shows a structural photograph of formation of pores.

The pore area ratio can be measured by a scanning electron microscope (SEM). The ratio of the total area of the pores in the area of 90 $\mu m^2$ of a range of 3 μm depth from the surfacemost layer (pore area ratio, unit %) is found by analysis using an image processing application. Further, the average value of 10 fields measured is defined as the pore area ratio (%). Even if the compound layer is less than 3 μm, similarly the part up to 3 μm depth from the surface is covered by measurement.

The pore area ratio is preferably 5% or less, more preferably 2% or less, still more preferably 1% or less, most preferably 0.

Next, one example of the method of manufacturing the nitrided part according to the present invention will be explained.

In the method of manufacturing the nitrided part according to the present invention, a steel material having the above-mentioned constituents is gas nitrided. The treatment temperature of the gas nitriding is 550 to 620° C., while the treatment time of the gas nitriding as a whole is 1.5 to 10 hours.

Treatment Temperature: 550 to 620° C.

The temperature of gas nitriding (nitriding temperature) is mainly correlated with the diffusion rate of nitrogen and has an effect on the surface hardness and hardened layer depth. If the nitriding temperature is too low, the diffusion rate of the nitrogen is slow, the surface hardness becomes lower, and the hardened layer depth becomes shallower. On the other hand, if the nitriding temperature is more than the $A_{C1}$ point, austenite phases (γ phases) with smaller diffusion rates of nitrogen than the ferrite phases (α phases) are formed in the steel, the surface hardness becomes lower, and the hardened layer depth becomes shallower. Therefore, in the present embodiment, the nitriding temperature is 550 to 620° C. around the ferrite temperature region. In this case, the surface hardness can be kept from becoming lower and the hardened layer depth can be kept from becoming shallower.

Treatment Time of Gas Nitriding as a Whole: 1.5 to 10 Hours

The gas nitriding is performed in an atmosphere including $NH_3$, $H_2$, and $N_2$. The time of the nitriding as a whole, that is, the time from the start to end of the nitriding (treatment time), is correlated with the formation and breakdown of the compound layer and diffusion and permeation of nitrogen and has an effect on the surface hardness and hardened layer depth. If the treatment time is too short, the surface hardness becomes lower and the hardened layer depth becomes shallower. On the other hand, if the treatment time is too long, the pore area ratio of the compound layer surface increases and the contact fatigue strength and rotating bending fatigue strength fall. If the treatment time is too long, further, the manufacturing cost becomes higher. Therefore, the treatment time of the nitriding as a whole is 1.5 to 10 hours.

Note that the atmosphere of the gas nitriding of the present embodiment includes not only $NH_3$, $H_2$, and $N_2$ and also unavoidably includes oxygen, carbon dioxide, and other impurities. The preferable atmosphere contains $NH_3$, $H_2$, and $N_2$ in a total of 99.5% (vol %) or more. If the contents of the impurities, in particular the carbon dioxide, in the atmosphere becomes higher, the presence of carbon ends up promoting the formation of non-γ' phases (ε phases), so preparation of the nitrided part of the present invention becomes difficult.

Gas Condition of Nitriding

In the method of nitriding of the nitrided part according to the present invention, the nitriding potential is controlled. Due to this, it is possible to make the area ratio of the γ' phases in the compound layer a predetermined range and make the pore area ratio in the range from the surface to a depth of 3 μm 10% or less.

The nitriding potential $K_N$ of the gas nitriding is defined by the following formula:

$$K_N\ (\mathrm{atm}^{-1/2}) = (NH_3 \text{ partial pressure (atm)})/[(H_2 \text{ partial pressure (atm)})^{3/2}]$$

The partial pressures of $NH_3$ and $H_2$ in the atmosphere of the gas nitriding can be controlled by adjusting the flow rates of the gases.

The inventors studied this and as a result discovered that the nitriding potential of the gas nitriding has an effect on the thickness, phase structure, and pore area ratio of the compound layer and the optimal nitriding potential has a lower limit of 0.15, an upper limit of 0.40, and average of 0.18 or more and less than 0.30.

In this way, when nitriding steel of the constituent system of the present invention, it is possible to raise the ratio of the γ' phases in the compound layer stably without complicating the nitriding condition and possible to make the pore area ratio in the range from the surface to a depth of 3 μm 10% or less. For this reason, it is possible to obtain a nitrided part with an excellent rotating bending fatigue strength, preferably a contact fatigue strength of 2400 MPa or more and a rotating bending fatigue strength of 600 MPa or more.

(2) Nitrided Part Excellent in Contact Fatigue Strength

As explained above, it is possible to raise the ratio of the γ' phases in the compound layer to raise the rotating bending fatigue strength. On the other hand, it was learned that the contact fatigue (contact fatigue accompanying tangential force due to slipping) strength peaked near a ratio of γ' phases of an area ratio of 70% and the contact fatigue strength fell with γ' phases greater than or less than that. This is believed to be due to the fact that in securing contact fatigue strength, a higher hardness of the compound layer is desirable. That is, if the γ' phases become more than 70% and become excessively great, the ratio of the ε phases which are harder compared with the γ' phases decreases. In particular, if more than 80%, the hardness of the compound layer becomes insufficient and as a result the contact fatigue strength seemingly drops. On the other hand, as explained above, if reducing the tough γ' phases and making them less than 50%, the rotating bending fatigue strength becomes insufficient. In the nitrided part according to the present invention, in particular in a nitrided part in which contact fatigue strength is demanded, the ratio of the γ' phases in the compound layer is defined as 50% or more and 80% or less in terms of the area ratio at the cross-section vertical to the surface.

The inventors discovered that by making CrN, VN, or other nitrides precipitate in the compound layer or making substitution type elements form solid solutions in the compound layer, it is possible to increase the hardness even in a compound layer with γ' phases of 50 to 80%. Specifically, by making the value X relating to the ratio of contents of C, Mn, Cr, V, and Mo $0 \leq X \leq 0.25$, it is possible to raise the hardness of the compound layer and raise the hardness of the contact fatigue strength. That is, in the nitrided part in the present invention, in particular by making $0 \leq X \leq 0.25$ and making the area ratio of the γ' phases of the nitrided iron at the compound layer 50% or more and 80% or less, it is possible to realize both contact fatigue strength and rotating bending fatigue strength at high levels compared with the past. In this nitrided part, it is possible to realize a hardness of the compound layer of 730 HV or more, but the hardness of the compound layer is preferably harder. Specifically, it is preferably 750 Hv or more.

(3) Nitrided Part Excellent in Rotating Bending Fatigue Strength

As explained above, by raising the ratio of the γ' phases at the compound layer, it is possible to raise the rotating bending fatigue strength. For this reason, in a product in which contact fatigue strength is not demanded that much (product in which tangential force or contact surface pressure is a certain level or less), in the nitrided part according to the present invention, the ratio of the γ' phases in the compound layer is preferably made 80% or more by area ratio at the cross-section vertical to the surface. However, in a product in which the tangential force or contact surface pressure is a certain level or less, in the case of making the γ' phases 80% or more, instead of the contact fatigue strength, the wear resistance becomes a problem. As explained above, γ' phases are lower in hardness compared with ε phases. In addition, in the case of γ' phases of 80% or more, the thickness of the compound layer becomes insufficient. As a result, the wear resistance was sometimes insufficient.

The inventors discovered that by suitably controlling the value of the X and specifically making $0.25 \leq X \leq 0.50$, it is possible to not only make the hardness of the compound layer suitable, but also secure the required thickness of the compound layer. That is, in the nitrided part in the present invention as well, in particular by making $0.25 \leq X \leq 0.50$ and making the area ratio of the γ' phases of the nitrided iron at the compound layer 80% or more, it is possible to achieve both a rotating bending fatigue strength and wear resistance at higher levels compared with the past. At the nitrided part, a hardness of the compound layer of 710 HV or more can be realized, but a harder hardness of the compound layer is preferable. Specifically, 730 Hv or more is preferable.

EXAMPLES

Example 1

In Example 1, nitrided parts particularly excellent in rotating bending fatigue strength and contact fatigue strength will be explained. Even among the nitrided parts according to the present invention, these are characterized in particular by $0 \leq X \leq 0.25$ and having an area ratio of the γ' phases in the nitrided iron at the compound layer of 50% or more and 80% or less.

Ingots "a" to ag having the chemical constituents shown in Tables 1-1 to 1-2 were manufactured in a 50 kg vacuum melting furnace. Note that "a" to "y" in Table 1-1 are steels having the chemical constituents prescribed in the examples. On the other hand, the steels "z" to ag shown in Table 1-2 are steels of comparative examples off from the chemical constituents prescribed in the examples in at least single elements or more.

TABLE 1-1

| | Chemical constituents (mass %)*1 | | | | | | | | | | | |
|---|---|---|---|---|---|---|---|---|---|---|---|---|
| Steel | C | Si | Mn | P | S | Cr | V | Al | N | Mo | Cu | NI |
| a | 0.15 | 0.21 | 1.50 | 0.015 | 0.010 | 1.01 | 0.25 | 0.028 | 0.0114 | 0.33 | | |
| b | 0.29 | 0.33 | 1.25 | 0.016 | 0.010 | 0.70 | 0.25 | 0.025 | 0.0132 | | | |
| c | 0.06 | 1.29 | 2.28 | 0.010 | 0.011 | 0.52 | 0.14 | 0.021 | 0.0181 | 0.20 | 0.15 | |
| d | 0.15 | 0.09 | 0.80 | 0.013 | 0.006 | 1.00 | 0.09 | 0.025 | 0.0152 | 0.21 | | |
| e | 0.24 | 0.50 | 0.78 | 0.013 | 0.009 | 1.08 | 0.10 | 0.025 | 0.0152 | | | |
| f | 0.08 | 0.19 | 0.80 | 0.017 | 0.009 | 0.95 | 0.41 | 0.025 | 0.0151 | 0.62 | | 0.11 |
| g | 0.13 | 0.06 | 2.47 | 0.011 | 0.031 | 0.51 | 0.10 | 0.025 | 0.0150 | 0.06 | | |
| h | 0.23 | 0.10 | 0.80 | 0.012 | 0.010 | 1.78 | 0.07 | 0.025 | 0.0152 | 0.23 | 0.02 | |
| i | 0.15 | 0.42 | 0.80 | 0.009 | 0.010 | 1.09 | 0.25 | 0.025 | 0.0151 | 0.35 | 0.38 | |
| j | 0.30 | 1.48 | 0.21 | 0.024 | 0.010 | 2.47 | 0.06 | 0.025 | 0.0154 | 0.46 | | 0.22 |
| k | 0.11 | 0.30 | 0.78 | 0.016 | 0.010 | 0.71 | 0.50 | 0.024 | 0.0153 | 0.55 | | 0.39 |
| l | 0.18 | 0.22 | 0.96 | 0.015 | 0.010 | 1.12 | 0.35 | 0.025 | 0.0153 | 0.45 | | |
| m | 0.06 | 0.20 | 1.15 | 0.010 | 0.010 | 1.79 | 0.38 | 0.025 | 0.0151 | 0.99 | 0.47 | |
| n | 0.09 | 0.21 | 1.49 | 0.010 | 0.010 | 1.10 | 0.24 | 0.025 | 0.0150 | 0.50 | | |
| o | 0.22 | 0.37 | 0.85 | 0.011 | 0.010 | 1.00 | 0.10 | 0.025 | 0.0151 | 0.01 | | |
| p | 0.08 | 0.46 | 0.70 | 0.009 | 0.011 | 0.99 | 0.08 | 0.025 | 0.0151 | 0.30 | 0.06 | 0.06 |

TABLE 1-1-continued

| | | | | | | | | | | | |
|---|---|---|---|---|---|---|---|---|---|---|---|
| q | 0.34 | 0.20 | 0.21 | 0.024 | 0.048 | 0.51 | 1.25 | 0.025 | 0.0104 | 1.18 | |
| r | 0.10 | 0.25 | 0.70 | 0.016 | 0.006 | 0.75 | 0.10 | 0.023 | 0.0083 | 0.20 | 0.15 |
| s | 0.31 | 1.32 | 0.99 | 0.014 | 0.003 | 0.65 | 0.44 | 0.003 | 0.0056 | 0.20 | |
| t | 0.25 | 0.23 | 0.39 | 0.010 | 0.029 | 0.52 | 1.09 | 0.021 | 0.0031 | 1.11 | |
| u | 0.33 | 0.22 | 0.70 | 0.012 | 0.007 | 1.82 | 0.12 | 0.038 | 0.0195 | 0.20 | |
| v | 0.10 | 0.19 | 0.85 | 0.014 | 0.010 | 1.10 | 0.11 | 0.015 | 0.0055 | 0.25 | |
| w | 0.33 | 0.28 | 0.43 | 0.009 | 0.005 | 0.85 | 0.27 | 0.012 | 0.0048 | | |
| x | 0.21 | 0.35 | 2.41 | 0.017 | 0.007 | 0.52 | 0.09 | 0.009 | 0.0052 | | |
| y | 0.05 | 0.74 | 0.67 | 0.015 | 0.011 | 1.21 | 0.25 | 0.013 | 0.0058 | 0.50 | |

| | Chemical constituents (mass %)*1 | | | | | | | | | |
|---|---|---|---|---|---|---|---|---|---|---|
| Steel | Nb | Ti | B | Ca | Pb | Bi | In | Sn | X*2 | Remarks |
| a | | | | | | | | | 0.21 | Inv. ex. |
| b | | | | | | | | | 0.24 | |
| c | | | | | | | | | 0.18 | |
| d | 0.020 | | | | | | | | 0.06 | |
| e | | 0.008 | 0.0010 | | | | | | 0.25 | |
| f | 0.016 | | | | | | | | 0.15 | |
| g | | | | | | | | | 0.17 | |
| h | | 0.009 | 0.0008 | | | | | | 0.22 | |
| i | 0.080 | | | | | | | | 0.19 | |
| j | | | | | | | | | 0.03 | |
| k | | | | | | | | | 0.23 | |
| l | | 0.037 | 0.0075 | | | | | | 0.18 | |
| m | 0.011 | 0.006 | | | | | | | 0.01 | |
| n | | | | | | | | | 0.10 | |
| o | | 0.018 | 0.0006 | | | | | | 0.24 | |
| p | 0.015 | | | | | | | | 0.05 | |
| q | 0.094 | 0.008 | | | | | | | 0.03 | |
| r | | 0.008 | 0.0009 | | | | | | 0.07 | |
| s | | | | | | | | | 0.21 | |
| t | | | | | | | | | 0.05 | |
| u | | | | 0.0062 | | | | | 0.16 | |
| v | | | | | 0.36 | | | | 0.20 | |
| w | | | | | | 0.38 | | | 0.24 | |
| x | | | | | | | 0.07 | | 0.08 | |
| y | | | | | | | | 0.064 | 0.23 | |

TABLE 1-2

| | Chemical constituents (mass %)*1 | | | | | | | | | | | |
|---|---|---|---|---|---|---|---|---|---|---|---|---|
| Steel | C | Si | Mn | P | S | Cr | V | Al | N | Mo | Cu | NI |
| z | 0.06 | 0.21 | 0.22 | 0.015 | 0.003 | 0.51 | 0.04 | 0.021 | 0.0240 | | | |
| aa | 0.34 | 0.15 | 0.19 | 0.018 | 0.044 | 1.30 | 0.11 | 0.021 | 0.0191 | | | |
| ab | 0.04 | 0.11 | 0.21 | 0.023 | 0.006 | 0.51 | 0.06 | 0.018 | 0.0240 | 0.20 | | |
| ac | 0.07 | 1.28 | 0.85 | 0.010 | 0.011 | 0.51 | 0.14 | 0.021 | 0.0182 | 0.08 | | |
| ad | 0.29 | 0.06 | 0.67 | 0.013 | 0.057 | 0.14 | 0.01 | 0.025 | 0.0150 | 0.01 | 0.20 | 0.12 |
| ae | 0.15 | 0.31 | 1.10 | 0.008 | 0.010 | 1.21 | 0.10 | 0.018 | 0.0040 | | 0.10 | 0.09 |
| af | 0.12 | 0.15 | 1.15 | 0.007 | 0.015 | 1.18 | 0.15 | 0.024 | 0.0050 | | | |
| ag | 0.23 | 0.85 | 1.00 | 0.013 | 0.016 | 1.00 | 0.25 | 0.018 | 0.0101 | | | |

| | Chemical constituents (mass %)*1 | | | | | | | | | |
|---|---|---|---|---|---|---|---|---|---|---|
| Steel | Nb | Ti | B | Ca | Pb | Bi | In | Sn | X*2 | Remarks |
| z | | | 0.0090 | | | | | | 0.21 | Comp. |
| aa | | | | | | | | | 0.14 | ex. |
| ab | 0.088 | 0.049 | 0.0950 | | | | | | −0.01 | |
| ac | | | | | | | | | 0.27 | |
| ad | | 0.008 | | | | | | | −0.51 | |
| ae | | 0.008 | | | | | | | 0.51 | |
| af | | | | | | | | | 0.65 | |
| ag | | | | | | | | | 0.51 | |

Figure 9:
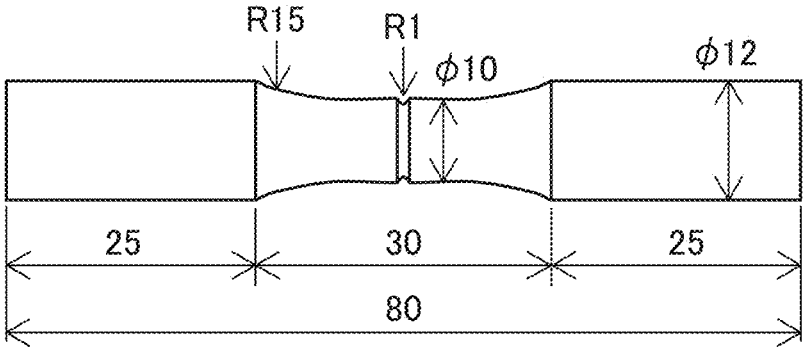
FIG. 9 shows the shape of a columnar test piece for evaluation of the rotating bending fatigue strength.

The ingots were hot forged to produce diameter 40 mm round bars. The hot forging was performed at a temperature from 1000° C. to 1100° C. After forging, they were allowed to cool in the atmosphere. Next, the round bars were annealed, then machined to fabricate small rollers for roller pitting test use for evaluating the contact fatigue strength shown in FIG. 7. From each ingot, several small rollers were prepared for the roller pitting tests. At that time, envisioning being examined at their cross-sections (for measurement of compound layer thickness and pore area ratio, measurement of the γ' phase ratio, and measurement of the compound layer hardness), more small rollers than the number required for the roller pitting tests were fabricated. Furthermore, using the same round bars as materials, columnar test pieces for evaluating the rotating bending fatigue strength shown in FIG. 9 were fabricated. A plurality of columnar test pieces were also prepared from each ingot for rotating bending fatigue tests.

Figure 7:
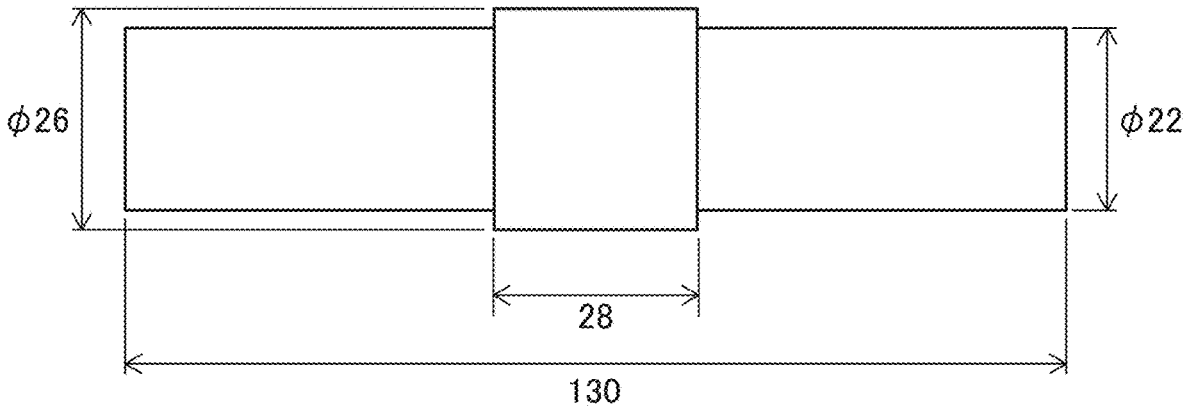
FIG. 7 shows the shape of a small roller for use in a roller pitting test used for evaluation of the contact fatigue strength and wear resistance.

The small rollers of the roller pitting test pieces, as shown in FIG. 7, are provided with center parts of φ26, test surface parts of widths of 28 mm, and φ22 gripping parts provided at the two side parts. In the roller pitting tests, the test surface parts were made to contact the large rollers and made to rotate while applying predetermined surface pressures.

The obtained test pieces were gas nitrided under the following conditions. The test pieces were loaded into a gas nitriding furnace into which the gases $NH_3$, $H_2$, and $N_2$ were introduced and then nitrided under the conditions shown in Tables 2-1 to 2-2. Provided, however, that Test No. 42 was made gas nitrocarburizing in which $CO_2$ gas was added into the atmosphere in a volume rate of 3%. The test pieces after gas nitriding were oil cooled using 80° C. oil.

The $H_2$ partial pressure in the atmosphere was measured using a thermal conductive type $H_2$ sensor directly attached to the gas nitriding furnace body. The difference in thermal conductivity between the standard gas and measurement gas was converted to gas concentration for the measurement. The $H_2$ partial pressure was measured continuously during the gas nitriding.

Further, the $NH_3$ partial pressure was measured using an infrared absorption type $NH_3$ analyzer attached to the outside of the furnace. The $NH_3$ partial pressure was measured continuously during the gas nitriding. Note that, in Test No. 42 with an atmosphere including $CO_2$ gas mixed in, $(NH_4)_2CO_3$ precipitated inside the infrared absorption type $NH_3$ analyzer making the apparatus susceptible to breakdown, so a glass tube type $NH_3$ analyzer was used to measure the $NH_3$ partial pressure every 10 minutes.

The $NH_3$ flow rate and $N_2$ flow rate were adjusted so that the nitriding potential $K_N$ calculated in the apparatus converged to the target values. Every 10 minutes, the nitriding potential $K_N$ was recorded and the lower limit value, upper limit value, and average value were calculated.

TABLE 2-1

| | | Gas nitriding | | | | | Compound layer | | | | | | |
|---|---|---|---|---|---|---|---|---|---|---|---|---|---|
| | | | | Nitriding potential $K_N$ | | | | | | | | | |
| Test no. | Steel | Temp. (° C.) | Time (h) | Min. | Max. ($atm^{-1/2}$) | Ave. | Thickness (μm) | γ' phase ratio (%) | Pore area ratio of surface layer (%) | Hardness (HV) | Pitting strength (MPa) | Rotating bending fatigue strength (MPa) | Remarks |
| 1 | a | 590 | 7.5 | 0.19 | 0.31 | 0.26 | 11 | 65 | 5 | 800 | 2700 | 620 | Inv. ex. |
| 2 | a | 590 | 7.5 | 0.21 | 0.39 | 0.28 | 14 | 55 | 7 | 810 | 2500 | 610 | |
| 3 | a | 590 | 7.5 | 0.15 | 0.33 | 0.21 | 6 | 70 | 3 | 760 | 2450 | 630 | |
| 4 | a | 560 | 10.0 | 0.18 | 0.34 | 0.27 | 14 | 50 | 8 | 820 | 2600 | 610 | |
| 5 | a | 610 | 5.0 | 0.16 | 0.24 | 0.19 | 10 | 50 | 9 | 740 | 2400 | 600 | |
| 6 | a | 590 | 7.5 | 0.20 | 0.32 | 0.24 | 10 | 60 | 7 | 790 | 2500 | 630 | |
| 7 | a | 580 | 8.0 | 0.17 | 0.25 | 0.21 | 7 | 75 | 2 | 750 | 2450 | 630 | |
| 8 | b | 590 | 7.5 | 0.17 | 0.37 | 0.22 | 11 | 55 | 4 | 740 | 2400 | 600 | |
| 9 | c | 590 | 7.5 | 0.21 | 0.35 | 0.23 | 10 | 60 | 3 | 760 | 2450 | 620 | |
| 10 | d | 590 | 7.5 | 0.17 | 0.36 | 0.26 | 8 | 65 | 5 | 750 | 2450 | 610 | |
| 11 | e | 590 | 7.5 | 0.19 | 0.32 | 0.21 | 5 | 75 | 2 | 730 | 2400 | 630 | |
| 12 | f | 590 | 7.5 | 0.18 | 0.32 | 0.24 | 12 | 70 | 5 | 830 | 2800 | 630 | |
| 13 | g | 590 | 7.5 | 0.20 | 0.36 | 0.22 | 7 | 75 | 3 | 760 | 2450 | 620 | |
| 14 | h | 590 | 7.5 | 0.19 | 0.32 | 0.27 | 13 | 55 | 4 | 800 | 2600 | 610 | |
| 15 | i | 580 | 9.0 | 0.18 | 0.33 | 0.24 | 8 | 60 | 6 | 790 | 2550 | 620 | |
| 16 | j | 590 | 7.5 | 0.17 | 0.35 | 0.24 | 13 | 50 | 6 | 820 | 2450 | 600 | |
| 17 | k | 590 | 7.5 | 0.19 | 0.32 | 0.22 | 7 | 60 | 4 | 800 | 2450 | 620 | |
| 18 | l | 590 | 7.5 | 0.20 | 0.31 | 0.23 | 6 | 65 | 3 | 820 | 2500 | 610 | |
| 19 | m | 590 | 7.5 | 0.18 | 0.28 | 0.23 | 13 | 50 | 8 | 780 | 2550 | 600 | |
| 20 | n | 590 | 7.5 | 0.20 | 0.34 | 0.23 | 9 | 60 | 4 | 800 | 2750 | 620 | |
| 21 | o | 590 | 7.5 | 0.19 | 0.38 | 0.25 | 6 | 75 | 3 | 760 | 2450 | 630 | |
| 22 | p | 590 | 7.5 | 0.16 | 0.35 | 0.23 | 8 | 65 | 4 | 780 | 2500 | 620 | |
| 23 | q | 590 | 5.0 | 0.19 | 0.34 | 0.23 | 9 | 55 | 3 | 810 | 2600 | 610 | |
| 24 | r | 590 | 7.5 | 0.19 | 0.27 | 0.23 | 10 | 65 | 5 | 800 | 2500 | 630 | |
| 25 | s | 590 | 7.5 | 0.16 | 0.37 | 0.25 | 8 | 65 | 5 | 820 | 2500 | 620 | |
| 26 | t | 590 | 7.5 | 0.16 | 0.35 | 0.25 | 10 | 55 | 4 | 850 | 2500 | 630 | |
| 27 | u | 590 | 7.5 | 0.17 | 0.34 | 0.27 | 8 | 65 | 4 | 810 | 2450 | 630 | |
| 28 | v | 590 | 7.5 | 0.16 | 0.36 | 0.23 | 6 | 70 | 5 | 780 | 2400 | 630 | |
| 29 | w | 570 | 7.5 | 0.18 | 0.35 | 0.24 | 5 | 75 | 5 | 760 | 2400 | 630 | |
| 30 | x | 590 | 7.5 | 0.17 | 0.35 | 0.26 | 7 | 60 | 6 | 780 | 2400 | 620 | |
| 31 | y | 590 | 7.5 | 0.18 | 0.37 | 0.26 | 5 | 75 | 3 | 750 | 2400 | 630 | |

TABLE 2-2

| Test no. | Steel | Gas nitriding Temp. (° C.) | Time (h) | Nitriding potential $K_N$ Min. | Max. ($atm^{-1/2}$) | Ave. | Compound layer Thickness (μm) | γ' phase ratio (%) | Pore area ratio of surface layer (%) | Hardness (HV) | Pitting strength (MPa) | Rotating bending fatigue strength (MPa) | Remarks |
|---|---|---|---|---|---|---|---|---|---|---|---|---|---|
| 32 | a | 610 | 10.0 | 0.25 | 0.39 | 0.30 | 16* | 30* | 18* | 770 | 2100* | 550* | Comp. |
| 33 | a | 570 | 3.0 | 0.15 | 0.25 | 0.17 | 3* | 100* | 0 | 720* | 1800* | 550* | ex. |
| 34 | a | 710 | 5.0 | 0.20 | 0.39 | 0.28 | 19* | 10* | 55* | 700* | 1700* | 490* | |
| 35 | a | 500 | 5.0 | 0.24 | 0.38 | 0.31 | 2* | 80 | 1 | 750 | 1800* | 500* | |
| 36 | a | 590 | 12.0 | 0.20 | 0.35 | 0.25 | 18* | 55 | 15* | 730 | 2000* | 580* | |
| 37 | a | 570 | 1.0 | 0.21 | 0.38 | 0.26 | 1* | 95* | 0 | 730 | 1850* | 480* | |
| 38 | a | 590 | 7.5 | 0.14 | 0.23 | 0.18 | 4* | 80 | 1 | 730 | 2200* | 560* | |
| 39 | a | 590 | 7.5 | 0.05 | 0.28 | 0.19 | 0* | — | — | — | 1600* | 550* | |
| 40 | a | 590 | 7.5 | 0.23 | 0.49 | 0.28 | 18* | 40* | 20* | 760 | 2000* | 590* | |
| 41 | a | 610 | 7.5 | 0.11 | 0.85 | 0.24 | 13 | 50 | 40* | 720* | 1900* | 540* | |
| 42* | a | 590 | 7.5 | 0.20 | 0.32 | 0.27 | 23* | 0* | 18* | 830 | 1750* | 500* | |
| 43 | z | 590 | 5.0 | 0.18 | 0.31 | 0.24 | 7 | 65 | 5 | 710* | 2100* | 570* | |
| 44 | aa | 600 | 9.0 | 0.20 | 0.35 | 0.28 | 15* | 40* | 9 | 770 | 1900* | 560* | |
| 45 | ab | 590 | 5.0 | 0.18 | 0.34 | 0.28 | 10 | 45* | 8 | 750* | 2400 | 590* | |
| 46 | ac | 590 | 7.5 | 0.17 | 0.36 | 0.25 | 10 | 80 | 4 | 710* | 2200* | 640 | |
| 47 | ad | 590 | 5.0 | 0.16 | 0.36 | 0.27 | 12 | 30* | 7 | 710* | 1800* | 490* | |
| 48 | ae | 590 | 5.0 | 0.18 | 0.28 | 0.19 | 4* | 85* | 2 | 710* | 2100* | 600 | |
| 49 | af | 590 | 5.0 | 0.15 | 0.23 | 0.20 | 3* | 90* | 1 | 730 | 2000* | 610 | |
| 50 | ag | 590 | 5.0 | 0.17 | 0.26 | 0.19 | 4* | 85* | 2 | 720* | 2050* | 630 | |

Underlines show outside scope of invention relating to nitrided part excellent in rotating bending fatigue strength and contact fatigue strength.
*indicates target not satisfied.
*indicates gas nitrocarburizing adding $CO_2$ gas to atmosphere by volume ratio of 3%.

Measurement of Compound Layer Thickness and Pore Area Ratio

In the small roller after gas nitriding, the test surface part (position of φ26 in FIG. 7) was cut along a section perpendicular to the longitudinal direction. The obtained cross-section was mirror polished and etched. A scanning electron microscope (SEM, made by JEOL; JSM-7100F) was used to examine the etched cross-section and to measure the compound layer thickness and confirm the presence of any pores at the surface layer part. The etching was performed by a 3% Nital solution for 20 to 30 seconds.

The compound layer can be observed as an uncorroded layer present at the surface layer. The compound layer was observed from 10 fields of a structural photograph taken by 4000× by a scanning electron microscope (field area: $6.6\times10^2$ $\mu m^2$) and the thickness of the compound layer was measured at 3 points every 10 μm. Further, the average value of the measured 30 points was defined as the compound layer thickness (μm).

The ratio of the total area of the pores in the area 90 $\mu m^2$ of the range from the surfacemost layer to a 3 μm depth (pore area ratio, unit %) was found by analyzing the above-mentioned structural photograph (10 fields) by an image processing application (made by JEOL Co., Ltd.: Analysis Station). Specifically, a region near the sample surface in the structural photograph of 3 μm in the depth direction ×30 μm in a direction parallel to the surface was extracted and area of the parts forming pores in the extracted region was calculated. The calculated area was divided by the area of the region extracted (90 $\mu m^2$) to measure the pore area ratio in that structural photograph. This calculation was performed in the 10 fields measured. The average value of the same was defined as the pore area ratio (%). Even in the case of a compound layer of less than 3 μm, similarly the range from the surface to a 3 μm depth was made the measured range.

Measurement of γ' Phase Ratio

The γ' phase ratio was found by image processing a structural photograph. Specifically, electron back scatter diffraction (EBSD, made by EDAX) was used to analyze a cross-sectional field vertical to the surface of the nitrided part acquired at 4000× and prepare a phase map. 10 of such phase maps were judged for the γ' phases and ε phases in the compound layer. The area ratio of the γ' phases in the compound layer was found by binarization by image processing. Further, the average value of the area ratios of the γ' phases of the measured 10 fields was defined as the γ' phase ratio (%).

Hardness of Compound Layer

The hardness of the compound layer was measured by the following method by a nanoindentation apparatus (made by Hysitron; TI950). At a position of the compound layer near the center in the thickness direction, 50 points were indented at random by an indentation load of 10 mN. The indenter was a triangular conical (Berkovich) shape. The hardness was derived based on ISO14577-1. The nanoindentation hardness $H_{IT}$ was converted to Vickers hardness HV by the following formula:

$$HV=0.0924\times H_{IT}$$

The average value of 50 points measured was defined as the hardness of the compound layer (HV).

Test for Evaluating Contact Fatigue Strength

The contact fatigue strength was evaluated by the following method by a roller pitting tester (made by Komatsu Setsubi Co., Ltd.: RP102). The small rollers for roller pitting test use were finished at the grip parts for the purpose of removing the heat treatment strain, then used for roller pitting test pieces. The shapes after finishing work are shown in FIG. 7.

Figure 8:
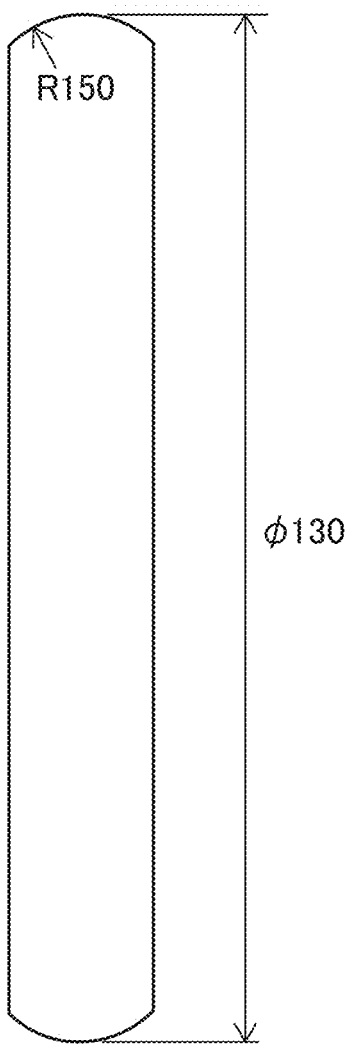
FIG. 8 shows the shape of a large roller for use in a roller pitting test used for evaluation of the contact fatigue strength and wear resistance.

The roller pitting tests were conducted under the conditions shown in Table 3 for combinations of the above small rollers for roller pitting test use and large rollers for roller pitting test use of the shape shown in FIG. 8. Note that, the large rollers were prepared under conditions different from the present invention and were not invention parts.

Note that, the units of dimensions in FIGS. 7 and 8 were "mm". The large rollers for roller pitting test use were fabricated using the steel satisfying the SCM420 standard of JIS G 4053 (2016) by the general manufacturing process, that is, the process of "normalizing→test piece working→eutectoid carburizing by gas carburizing furnace→low temperature tempering→polishing". The Vickers hardness HV at a position of 0.05 mm from the surface, that is, a position of a depth of 0.05 mm, was 740 to 760. Further, the depth of Vickers hardness HV of 550 or more was a range of 0.8 to 1.0 mm.

Table 3 shows the test conditions evaluating the contact fatigue strength. The test was cut off after $2\times10^7$ cycles showing the fatigue limit of general steel. The maximum surface pressure when reaching $2\times10^7$ cycles without pitting occurring in the small roller test pieces was made the fatigue limit of the small roller test pieces. In the roller pitting test, in particular near the fatigue limit, the test was conducted by 50 MPa increments of surface pressure. That is, the values of pitting strength shown in Tables 2-1 to 2-2 show that in the tests concerned, pitting did not occur in the small roller test pieces tested under the same surface pressures, but pitting occurred in the small roller test pieces tested under surface pressures 50 MPa higher than the same surface pressure.

TABLE 3

| | |
|---|---|
| Tester | Roller pitting tester |
| Test piece size | Small roller: diameter 26 mm<br>Large roller: diameter 130 mm<br>Contact part 150 mmR |
| Surface pressure | 1500 to 3000 MPa |
| Slip rate | −40% |
| Small roller speed | 2000 rpm |
| Peripheral speed | Small roller: 163 m/min<br>Large roller: 229 m/min |
| Lubrication oil | Type: Automatic transmission use oil<br>Oil temperature: 80° C. |

The occurrence of pitting was detected by a vibration meter attached to the tester. After causing vibration, the rotations of both of the small roller test pieces and large roller test pieces were stopped and the occurrence of pitting and the speed were checked. In this example, application to gear parts was envisioned and a surface pressure at the fatigue limit in the roller pitting test shown in FIG. 3 of 2400 MPa or more was targeted.

Test for Evaluating Rotating Bending Fatigue Strength

The columnar test pieces used for the gas nitriding were subjected to an Ono-type rotating bending fatigue test based on JIS Z 2274 (1978). The speed was made 3000 rpm, the cutoff cycles of the test was made $1\times10^7$ cycles showing the fatigue limit of general steel, and, in the rotating bending fatigue test piece, the maximum stress reached at $1\times10^7$ cycles without fracture occurring was made the fatigue limit of the rotating bending fatigue test pieces. In the rotating bending fatigue test, in particular near the fatigue limit, the test was conducted by 10 MPa increments of stress. That is, the values of the rotating bending fatigue strength shown in Tables 2-1 to 2-2 show that in the tests concerned, no fractures occurred in the columnar test pieces tested under the same stress, but fracture occurred in the columnar test pieces tested under stress 10 MPa higher than the same stress.

In this example, application to gear parts was envisioned and a stress at the fatigue limit at the Ono-type rotating bending fatigue test was 600 MPa or more was targeted.

Test Results

The results are shown in Tables 2-1 to 2-2. Test Nos. 1 to 31 had constituents of steel and conditions of gas nitriding within the ranges envisioned in this example. The compound layer thicknesses were 5 to 15 μm, the ratios of γ' phases of the compound layers were 50% or more and 80% or less, and the pore area ratios of the compound layers were 10% or less. As a result, the hardnesses of the compound layers became 730 Hv or more (measurement load 10 mN), the contact fatigue strengths were 2400 MPa or more, and the rotating bending fatigue strengths were 600 MPa or more, that is, good results were obtained.

Test Nos. 32 to 50 had some of the steel constituents and the conditions of the gas nitriding outside the scopes envisioned in the example. One or more properties among the thickness, γ' phases, and pore area ratio of the compound layer failed to reach the target value. As a result, the contact fatigue strength or the rotating bending fatigue strength failed to satisfy the target. For example, in Test No. 42, the atmosphere in the gas nitriding contained carbon dioxide so the treatment was nitrocarburizing, so the compound layer formed was thick or the ratio of γ' phases was low (ε phases were formed), the pore area ratio became high, and sufficient properties could not be obtained from the viewpoint of the pitting strength and rotating bending fatigue strength.

Note that, Test No. 46 was a comparative example with a contact fatigue strength failing to reach the target value, but was a part suitable as a nitrided part excellent in rotating bending fatigue strength and wear resistance of the later explained Example 2. The steel ac used for Test No. 46 is also the steel "b" of the invention example of Example 2.

Example 2

In Example 2, nitrided parts particularly excellent in rotating bending fatigue strength and wear resistance will be explained. Even among the nitrided parts according to the present invention, these are characterized in particular by $0.25\leq X\leq0.50$ and having an area ratio of the γ' phases in the nitrided iron at the compound layer of 80% or more.

Ingots "a" to ag having the chemical constituents shown in Tables 4-1 to 4-2 were manufactured in a 50 kg vacuum melting furnace. Note that "a" to "y" in Table 4-1 are steels having the chemical constituents prescribed in the examples. On the other hand, the steels "z" to ag shown in Table 4-2 are steels of comparative examples off from the chemical constituents prescribed in the examples in at least single elements or more.

TABLE 4-1

| | Chemical constituents (mass %)*1 | | | | | | | | | | | |
|---|---|---|---|---|---|---|---|---|---|---|---|---|
| Steel | C | Si | Mn | P | S | Cr | V | Al | N | Mo | Cu | NI |
| a | 0.15 | 0.20 | 1.65 | 0.015 | 0.010 | 1.00 | 0.26 | 0.028 | 0.0110 | 0.21 | | |
| b | 0.07 | 1.28 | 0.85 | 0.010 | 0.011 | 0.51 | 0.14 | 0.021 | 0.0182 | 0.08 | | |
| c | 0.13 | 0.09 | 0.80 | 0.013 | 0.006 | 0.99 | 0.11 | 0.025 | 0.0131 | | | |

TABLE 4-1-continued

| | | | | | | | | | | | | |
|---|---|---|---|---|---|---|---|---|---|---|---|---|
| d | 0.24 | 0.50 | 0.80 | 0.013 | 0.009 | 1.11 | 0.13 | 0.020 | 0.0153 | | 0.08 | |
| e | 0.27 | 0.33 | 1.25 | 0.012 | 0.010 | 1.26 | 0.20 | 0.025 | 0.0130 | | | |
| f | 0.08 | 0.19 | 2.28 | 0.017 | 0.009 | 0.95 | 0.35 | 0.025 | 0.0151 | 0.45 | | 0.11 |
| g | 0.13 | 0.06 | 2.47 | 0.011 | 0.031 | 0.51 | 0.10 | 0.025 | 0.0153 | | | |
| h | 0.10 | 0.38 | 0.80 | 0.010 | 0.010 | 1.04 | 0.26 | 0.023 | 0.0151 | 0.30 | | 0.18 |
| i | 0.30 | 1.48 | 0.21 | 0.024 | 0.010 | 2.49 | 0.06 | 0.025 | 0.0150 | 0.16 | | 0.22 |
| j | 0.12 | 0.30 | 0.78 | 0.016 | 0.010 | 0.88 | 0.50 | 0.024 | 0.0151 | 0.55 | | 0.39 |
| k | 0.30 | 0.22 | 0.20 | 0.015 | 0.009 | 0.50 | 1.08 | 0.025 | 0.0150 | 0.78 | | |
| l | 0.15 | 0.20 | 0.85 | 0.010 | 0.010 | 1.67 | 0.23 | 0.025 | 0.0152 | 0.35 | 0.47 | |
| m | 0.09 | 0.22 | 1.49 | 0.010 | 0.010 | 1.10 | 0.29 | 0.022 | 0.0152 | 0.35 | | |
| n | 0.28 | 0.10 | 0.80 | 0.012 | 0.010 | 1.78 | 0.07 | 0.025 | 0.0150 | 0.01 | 0.02 | |
| o | 0.10 | 0.58 | 0.85 | 0.011 | 0.010 | 1.00 | 0.10 | 0.045 | 0.0151 | | | |
| p | 0.08 | 0.46 | 0.70 | 0.009 | 0.011 | 0.99 | 0.08 | 0.023 | 0.0151 | 0.07 | 0.10 | 0.22 |
| q | 0.34 | 0.08 | 0.22 | 0.024 | 0.048 | 0.52 | 1.26 | 0.025 | 0.0103 | 0.96 | | |
| r | 0.11 | 0.20 | 0.85 | 0.016 | 0.007 | 0.78 | 0.10 | 0.023 | 0.0084 | | 0.11 | |
| s | 0.30 | 0.85 | 1.00 | 0.013 | 0.010 | 0.69 | 0.52 | 0.003 | 0.0060 | 0.18 | | |
| t | 0.20 | 0.33 | 0.38 | 0.010 | 0.010 | 0.88 | 0.75 | 0.025 | 0.0032 | 0.65 | | |
| u | 0.15 | 0.32 | 0.85 | 0.011 | 0.003 | 1.25 | 0.25 | 0.028 | 0.0048 | 0.21 | | |
| v | 0.11 | 0.21 | 0.84 | 0.014 | 0.010 | 1.00 | 0.23 | 0.010 | 0.0058 | 0.25 | | |
| w | 0.24 | 0.28 | 0.41 | 0.008 | 0.005 | 1.11 | 0.31 | 0.020 | 0.0052 | 0.18 | | |
| x | 0.26 | 0.27 | 2.32 | 0.018 | 0.008 | 1.21 | 0.16 | 0.011 | 0.0055 | | | |
| y | 0.06 | 0.65 | 0.70 | 0.010 | 0.012 | 1.25 | 0.09 | 0.016 | 0.0053 | 0.26 | | |

| | Chemical constituents (mass %)*1 | | | | | | | | | |
|---|---|---|---|---|---|---|---|---|---|---|
| Steel | Nb | Ti | B | Ca | Pb | Bi | In | Sn | X*2 | Remarks |
| a | | | | | | | | | 0.40 | Inv. ex. |
| b | | | | | | | | | 0.27 | |
| c | | 0.008 | | | | | | | 0.45 | |
| d | 0.017 | | | | | | | | 0.32 | |
| e | | | | | | | | | 0.47 | |
| f | 0.016 | | | | | | | | 0.35 | |
| g | | | | | | | | | 0.26 | |
| h | 0.050 | | | | | | | | 0.36 | |
| i | | | | | | | | | 0.49 | |
| j | | | | | | | | | 0.29 | |
| k | | 0.037 | 0.0075 | | | | | | 0.40 | |
| l | 0.011 | 0.006 | | | | | | | 0.44 | |
| m | | | | | | | | | 0.42 | |
| n | | 0.009 | 0.0008 | | | | | | 0.45 | |
| o | | 0.021 | 0.0006 | | | | | | 0.50 | |
| p | | | | | | | | | 0.39 | |
| q | 0.094 | 0.008 | | | | | | | 0.38 | |
| r | 0.016 | 0.008 | 0.0010 | | | | | | 0.37 | |
| s | | | | | | | | | 0.42 | |
| t | | | | | | | | | 0.41 | |
| u | | | | 0.0070 | | | | | 0.48 | |
| v | | | | | 0.38 | | | | 0.34 | |
| w | | | | | | 0.32 | | | 0.36 | |
| x | | | | | | | 0.07 | | 0.44 | |
| y | | | | | | | | 0.071 | 0.30 | |

TABLE 4-2

| | Chemical constituents (mass %)*1 | | | | | | | | | | | |
|---|---|---|---|---|---|---|---|---|---|---|---|---|
| Steel | C | Si | Mn | P | S | Cr | V | Al | N | Mo | Cu | NI |
| z | 0.25 | 0.21 | 0.18 | 0.015 | 0.003 | 0.49 | 0.35 | 0.021 | 0.0243 | | | |
| aa | 0.36 | 0.33 | 1.54 | 0.018 | 0.044 | 1.80 | 0.04 | 0.021 | 0.0191 | | | |
| ab | 0.04 | 0.11 | 0.21 | 0.023 | 0.006 | 0.51 | 0.06 | 0.018 | 0.0243 | 0.01 | | |
| ac | 0.11 | 0.30 | 0.78 | 0.016 | 0.010 | 0.71 | 0.50 | 0.024 | 0.0153 | 0.55 | | 0.39 |
| ad | 0.29 | 0.06 | 0.67 | 0.013 | 0.057 | 0.14 | 0.01 | 0.025 | 0.0150 | 0.01 | 0.20 | 0.12 |
| ae | 0.15 | 0.31 | 1.10 | 0.008 | 0.010 | 1.21 | 0.10 | 0.018 | 0.0040 | | 0.10 | 0.09 |
| af | 0.12 | 0.15 | 1.15 | 0.007 | 0.015 | 1.18 | 0.15 | 0.024 | 0.0050 | | | |
| ag | 0.23 | 0.85 | 1.00 | 0.013 | 0.016 | 1.00 | 0.25 | 0.018 | 0.0101 | | | |

| | Chemical constituents (mass %)*1 | | | | | | | | | |
|---|---|---|---|---|---|---|---|---|---|---|
| Steel | Nb | Ti | B | Ca | Pb | Bi | In | Sn | X*2 | Remarks |
| z | | | 0.0090 | | | | | | 0.36 | Comp. |
| aa | | | | | | | | | 0.28 | ex. |
| ab | 0.088 | 0.049 | 0.0950 | | | | | | 0.27 | |
| ac | | | | | | | | | 0.23 | |

TABLE 4-2-continued

| | | |
|---|---|---|
| ad | 0.008 | −0.51 |
| ae | 0.008 | 0.51 |
| af | | 0.65 |
| ag | | 0.51 |

The ingots were hot forged to produce diameter 40 mm round bars. In the same way as Example 1, the hot forging was performed at a temperature from 1000° C. to 1100° C. After forging, they were allowed to cool in the atmosphere. Next, the round bars were annealed, then machined to fabricate small rollers for roller pitting test use for evaluating the wear resistance shown in FIG. 7. In the same way as Example 1, in addition to the number used for the roller pitting tests, a number used for examination of the cross-sections were fabricated under the same conditions. Furthermore, using the same round bars as materials, columnar test pieces for evaluating the rotating bending fatigue strength shown in FIG. 9 were fabricated.

The obtained test pieces were gas nitrided under the following conditions. The test pieces were loaded into a gas nitriding furnace into which the gases $NH_3$, $H_2$, and $N_2$ were introduced and then nitrided under the conditions shown in Tables 5-1 to 5-2. Provided, however, that, Test No. 42 was made gas nitrocarburizing in which $CO_2$ gas was added into the atmosphere in a volume rate of 3%. The test pieces after gas nitriding were oil cooled using 80° C. oil.

The partial pressures of $H_2$, $NH_3$ in the atmosphere were measured by the same method as in Example 1. Further, the nitriding potential $K_N$ was controlled during the nitriding treatment by the same method as Example 1 as well.

TABLE 5-1

| | | Gas nitriding | | | | | Compound layer | | | | | | |
|---|---|---|---|---|---|---|---|---|---|---|---|---|---|
| | | | | Nitriding potential $K_N$ | | | | | | | | | |
| Test no. | Steel | Temp. (° C.) | Time (h) | Min. | Max. ($atm^{-1/2}$) | Ave. | Thickness (μm) | γ' phase ratio (%) | Pore area ratio of surface layer (%) | Hardness (HV) | Wear depth (μm) | Rotating bending fatigue strength (MPa) | Remarks |
| 1 | a | 590 | 7.5 | 0.18 | 0.25 | 0.23 | 10 | 85 | 5 | 780 | 3 | 680 | Inv. ex. |
| 2 | a | 590 | 7.5 | 0.22 | 0.39 | 0.28 | 13 | 80 | 9 | 720 | 7 | 650 | |
| 3 | a | 590 | 7.5 | 0.15 | 0.35 | 0.22 | 5 | 80 | 7 | 730 | 3 | 670 | |
| 4 | a | 560 | 9.5 | 0.16 | 0.36 | 0.29 | 12 | 90 | 8 | 750 | 6 | 660 | |
| 5 | a | 610 | 4.5 | 0.15 | 0.24 | 0.18 | 10 | 80 | 5 | 760 | 4 | 660 | |
| 6 | a | 590 | 7.5 | 0.17 | 0.32 | 0.24 | 8 | 85 | 8 | 740 | 5 | 650 | |
| 7 | a | 580 | 8.0 | 0.18 | 0.25 | 0.27 | 11 | 80 | 2 | 760 | 4 | 660 | |
| 8 | b | 590 | 7.5 | 0.17 | 0.36 | 0.25 | 10 | 80 | 4 | 710 | 7 | 640 | |
| 9 | c | 590 | 7.5 | 0.20 | 0.35 | 0.24 | 9 | 85 | 4 | 730 | 6 | 660 | |
| 10 | d | 590 | 7.5 | 0.17 | 0.35 | 0.23 | 7 | 85 | 5 | 740 | 4 | 660 | |
| 11 | e | 590 | 7.5 | 0.19 | 0.32 | 0.23 | 5 | 85 | 3 | 750 | 3 | 670 | |
| 12 | f | 590 | 7.5 | 0.18 | 0.36 | 0.24 | 11 | 80 | 3 | 800 | 2 | 680 | |
| 13 | g | 590 | 7.5 | 0.20 | 0.35 | 0.22 | 6 | 80 | 3 | 760 | 3 | 650 | |
| 14 | h | 590 | 7.5 | 0.16 | 0.32 | 0.23 | 9 | 80 | 6 | 770 | 5 | 650 | |
| 15 | i | 580 | 9.0 | 0.20 | 0.33 | 0.27 | 5 | 90 | 2 | 830 | 1 | 690 | |
| 16 | j | 590 | 7.5 | 0.17 | 0.35 | 0.24 | 10 | 85 | 5 | 740 | 4 | 650 | |
| 17 | k | 590 | 7.5 | 0.18 | 0.37 | 0.26 | 6 | 80 | 4 | 850 | 1 | 640 | |
| 18 | l | 590 | 7.5 | 0.19 | 0.30 | 0.21 | 5 | 85 | 1 | 810 | 2 | 640 | |
| 19 | m | 590 | 7.5 | 0.18 | 0.29 | 0.22 | 9 | 90 | 4 | 780 | 5 | 710 | |
| 20 | n | 590 | 7.5 | 0.18 | 0.35 | 0.23 | 10 | 85 | 5 | 800 | 2 | 670 | |
| 21 | o | 590 | 7.5 | 0.19 | 0.38 | 0.25 | 6 | 80 | 4 | 790 | 2 | 640 | |
| 22 | p | 590 | 7.5 | 0.16 | 0.35 | 0.24 | 8 | 85 | 3 | 800 | 2 | 650 | |
| 23 | q | 590 | 7.5 | 0.19 | 0.34 | 0.23 | 7 | 80 | 2 | 820 | 9 | 640 | |
| 24 | r | 590 | 7.5 | 0.20 | 0.26 | 0.23 | 8 | 85 | 4 | 760 | 6 | 670 | |
| 25 | s | 590 | 7.5 | 0.18 | 0.35 | 0.26 | 10 | 80 | 6 | 780 | 7 | 660 | |
| 26 | t | 590 | 7.5 | 0.18 | 0.35 | 0.26 | 8 | 85 | 5 | 780 | 7 | 650 | |
| 27 | u | 590 | 7.5 | 0.17 | 0.37 | 0.26 | 6 | 90 | 4 | 750 | 8 | 640 | |
| 28 | v | 590 | 7.5 | 0.17 | 0.38 | 0.25 | 6 | 85 | 5 | 760 | 8 | 640 | |
| 29 | w | 570 | 7.5 | 0.18 | 0.35 | 0.23 | 9 | 80 | 4 | 760 | 9 | 650 | |
| 30 | x | 590 | 7.5 | 0.18 | 0.34 | 0.24 | 10 | 80 | 4 | 750 | 8 | 640 | |
| 31 | y | 590 | 7.5 | 0.18 | 0.36 | 0.24 | 9 | 80 | 5 | 760 | 8 | 640 | |

TABLE 5-2

| Test no. | Steel | Gas nitriding Temp. (° C.) | Time (h) | Nitriding potential $K_N$ Min. | Max. ($atm^{-1/2}$) | ratio | Compound layer Thickness (μm) | γ' phase ratio (%) | Pore area ratio of surface layer (%) | Hardness (HV) | Wear depth (μm) | Rotating bending fatigue strength (MPa) | Remarks |
|---|---|---|---|---|---|---|---|---|---|---|---|---|---|
| 32 | a | 620 | 10.0 | 0.26 | 0.39 | 0.30 | 15* | 40* | 13* | 750 | 7 | 570* | Comp. |
| 33 | a | 570 | 4.0 | 0.16 | 0.26 | 0.17 | 2* | 100 | 0 | 700* | 55* | 610* | ex. |
| 34 | a | 690 | 7.5 | 0.23 | 0.39 | 0.29 | 18* | 20* | 35* | 670* | 28* | 510* | |
| 35 | a | 500 | 5.0 | 0.22 | 0.35 | 0.27 | 0* | — | — | — | 83* | 470* | |
| 36 | a | 590 | 15.0 | 0.22 | 0.33 | 0.24 | 14 | 85 | 13* | 720 | 8 | 600* | |
| 37 | a | 590 | 1.0 | 0.21 | 0.38 | 0.23 | 1* | 85 | 0 | 730 | 23* | 510* | |
| 38 | a | 590 | 7.5 | 0.14 | 0.23 | 0.18 | 4* | 90 | 3 | 740 | 12 | 560* | |
| 39 | a | 590 | 7.5 | 0.05 | 0.28 | 0.19 | 0* | — | — | — | 78* | 560* | |
| 40 | a | 590 | 7.5 | 0.17 | 0.49 | 0.28 | 16* | 55* | 15* | 780 | 6 | 590* | |
| 41 | a | 610 | 7.5 | 0.11 | 0.85 | 0.24 | 13 | 50* | 38* | 660* | 11* | 550* | |
| 42* | a | 590 | 7.5 | 0.20 | 0.32 | 0.27 | 20* | 0* | 15* | 830 | 7 | 520* | |
| 43 | z | 590 | 5.0 | 0.18 | 0.30 | 0.24 | 10 | 80 | 7 | 710 | 8 | 570* | |
| 44 | aa | 590 | 5.5 | 0.19 | 0.37 | 0.28 | 15 | 55* | 9 | 790 | 7 | 620* | |
| 45 | ab | 590 | 5.0 | 0.18 | 0.34 | 0.26 | 11 | 85 | 7 | 690* | 13* | 600* | |
| 46 | ac | 590 | 7.5 | 0.21 | 0.38 | 0.27 | 8 | 65 | 3 | 780 | 6 | 630* | |
| 47 | ad | 590 | 5.0 | 0.16 | 0.36 | 0.22 | 11 | 50 | 3 | 700* | 13* | 490* | |
| 48 | ae | 590 | 5.0 | 0.18 | 0.28 | 0.19 | 4* | 85 | 2 | 710 | 15* | 600* | |
| 49 | af | 590 | 5.0 | 0.15 | 0.23 | 0.20 | 3* | 90 | 1 | 730 | 14* | 610* | |
| 50 | ag | 590 | 5.0 | 0.17 | 0.26 | 0.19 | 4* | 85 | 2 | 720 | 16* | 630* | |

Underlines mean outside scope of invention relating to nitrided part excellent in rotating bending fatigue strength and wear resistance.
*indicate not satisfying target.
*indicates gas nitrocarburizing adding $CO_2$ gas to atmosphere in volume ratio of 3%.

The small rollers after gas nitriding were measured by methods similar to Example 1 for thicknesses of the compound layers, ratios of the γ' phases in the compound layers (area ratios), pore area ratios, and hardnesses of the compound layers.

Test for Evaluation of Wear Resistance

The wear resistance was evaluated by the following method by a roller pitting tester (made by Komatsu Setsubi Co., Ltd.; RP102). The small rollers for roller pitting test use were finished at the grip parts for the purpose of removing the heat treatment strain, then used for roller pitting test pieces. The shapes after finishing work were the same as that of Example 1 shown in FIG. 7.

The roller pitting tests were conducted under the conditions shown in Table 6 for combinations of the above small rollers for roller pitting test use and large rollers for roller pitting test use of the shape shown in FIG. 8. Note that, the large rollers were prepared under conditions different from the present invention and were not invention parts.

Note that, the units of dimensions in FIGS. 7 and 8 were "mm". The large rollers for roller pitting test use were fabricated using the steel satisfying the SCM420 standard of JIS G 4053 (2016) by the general manufacturing process, that is, the process of "normalizing→test piece working→eutectoid carburizing by gas carburizing furnace→low temperature tempering→polishing". The Vickers hardness HV at a position of 0.05 mm from the surface, that is, a position of a depth of 0.05 mm, was 740 to 760. Further, the depth of Vickers hardness HV of 550 or more was a range of 0.8 to 1.0 mm.

Table 6 shows the test conditions evaluating the wear resistance. The test was cut off after $2\times10^6$ repeated cycles. A roughness meter was used to scan the worn parts of the small roller in the main axis direction. The maximum wear depth was measured and the average value of the wear depth was calculated with N=5. In the present example, application to a CVT or camshaft part was envisioned and a wear depth by roller pitting test shown in Table 6 of 10 μm or less was targeted.

TABLE 6

| | |
|---|---|
| Tester | Roller pitting tester |
| Test piece size | Small roller: diameter 26 mm<br>Large roller: diameter 130 mm<br>Contact part 150 mmR |
| Surface pressure | 1700 MPa |
| No. of tests | 5 |
| Slip rate | 0% |
| Small roller speed | 2000 rpm |
| Peripheral speed | Small roller: 163 m/min<br>Large roller: 163 m/min |
| Lubrication oil | Type: Automatic transmission use oil<br>Oil temperature: 80° C. |

Test Evaluating Rotating Bending Fatigue Strength

The columnar test piece used for the gas nitriding was subjected to an Ono-type rotating bending fatigue test based on JIS Z 2274 (1978). The speed was made 3000 rpm, the cutoff cycle of the test was made $1\times10^7$ cycles showing the fatigue limit of general steel, and, in the rotating bending fatigue test piece, the maximum stress reached at $1\times10^7$ cycles without fracture occurring was made the fatigue limit of the rotating bending fatigue test piece.

In the nitrided part excellent in rotating bending fatigue strength and wear resistance, application to a CVT or camshaft part was envisioned and a wear depth of 10 μm or less and the maximum stress at the fatigue limit of 640 MPa or more were targeted.

Test Results

The results are shown in Tables 5-1 to 5-2. Test Nos. 1 to 31 had constituents of the steel and conditions of the gas nitriding within the ranges envisioned in the examples, had compound layer thicknesses of 5 to 15 μm, had γ' phase ratios of the compound layer of 80% or more, and had compound layer pore area ratios of 10% or less. As a result, the hardnesses of the compound layers became 710 Hv (measurement load 10 mN), wear depths of 10 μm or less, and rotating bending fatigue strengths of 640 MPa or more, i.e., good results were obtained.

Test Nos. 32 to 50 had some of the steel constituents and the conditions of the gas nitriding outside the scopes envisioned in the example. One or more properties among the thickness, γ' phases, and pore area ratio of the compound layer failed to reach the target value. As a result, the wear resistance or the rotating bending fatigue strength failed to satisfy the target. For example, in Test No. 42, the atmosphere in the gas nitriding contained carbon dioxide and the treatment was nitrocarburizing, so the ratio of the γ' phases in the compound layer formed became lower (ε phases were formed) and a sufficient property could not be obtained from the viewpoint of the rotating bending fatigue strength.

Note that, Test No. 46 is a comparative example in which the rotating bending fatigue strength failed to reach the target value, but the target value of the rotating bending fatigue strength at Example 1 (example envisioning gear parts) was cleared and the part was suitable as a nitrided part excellent in rotating bending fatigue strength and contact fatigue strength. The steel ac used for Test No. 46 is also the steel "k" of the invention example of Example 1.

Above, embodiments of the present invention were explained. However, the above-mentioned embodiments are just illustrations for working the present invention. Therefore, the present invention is not limited to the above-mentioned embodiments. The above-mentioned embodiments may be suitably changed within a scope not deviating from the gist of the invention to work the invention.

The invention claimed is:

1. A nitrided part comprising a steel core containing, by mass %,

C: 0.05 to 0.35%,

Si: 0.05 to 1.50%,

Mn: 0.20 to 2.50%,

P: 0.025% or less,

S: 0.050% or less,

Cr: 0.50 to 2.50%,

V: 0.05 to 1.30%,

Al: 0.050% or less,

N: 0.0250% or less,

Mo: 0 to 1.50%,

Cu: 0 to 0.50%,

Ni: 0 to 0.50%,

Nb: 0 to 0.100%,

Ti: 0 to 0.050%,

B: 0 to 0.0100%,

Ca: 0 to 0.0100%,

Pb: 0 to 0.50%,

Bi: 0 to 0.50%,

In: 0 to 0.20%,

Sn: 0 to 0.100%, and a balance of Fe and impurities, a nitrogen diffusion layer formed on the steel core, and a compound layer formed on the nitrogen diffusion layer, 90% or more of elements included in the compound layer being nitrogen and iron, the compound layer having a thickness of 5 to 15 μm, wherein in a cross-section perpendicular to a surface of the compound layer, a pore area ratio in a range from the surface to a depth of 3 μm from the surface is 10% or less, if defining the X determined based on the contents of C, Mn, Cr, V, and Mo at the steel core as $$X=-2.1\times C+0.04\times Mn+0.5\times Cr+1.8\times V-1.5\times Mo,$$

(i) $0\leq X\leq 0.25$ and an area ratio of γ' phases of the nitride iron in the compound layer is 50% or more and 80% or less or (ii) $0.25\leq X\leq 0.50$ and an area ratio of γ' phases of the nitride iron in the compound layer is 80% or more, wherein the pore area ratio is measured by a scanning electron microscope, the ratio of the total area of the pores in the area of 90 $\mu m^2$ of a range of 3 μm depth from the surfacemost layer being found by analysis using an image processing application, the average value of 10 fields measured being defined as the pore area ratio; and the area ratio of the γ' phases is found by image processing structural photographs, by using electron back scatter diffraction (EBSD), 10 structural photographs of cross-sections of 90 $\mu m^2$ perpendicular to the surface at the nitrided part surface layer photographed at 4000× being examined to differentiate the γ' phases and ε phases in the compound layer, the area ratios of the γ' phases in the compound layer being found by binarization by image processing, the average value of the area ratios of the γ' phases of the 10 fields measured being defined as the area ratio of the γ' phases.

2. The nitrided part according to claim 1, wherein $0\leq X\leq 0.25$ and an area ratio of the γ' phase of the nitride iron in the compound layer is 50% or more and 80% or less.

3. The nitrided part according to claim 1, wherein $0.25\leq X\leq 0.50$ and an area ratio of the γ' phase of the nitride iron in the compound layer is 80% or more.

4. The nitrided part according to claim 3, wherein the area ratio of the γ' phase of the nitride iron in the compound layer is 90% or less.

* * * * *